US007316735B2

(12) United States Patent
Tomimatsu et al.

(10) Patent No.: US 7,316,735 B2
(45) Date of Patent: Jan. 8, 2008

(54) DUST COLLECTOR

(75) Inventors: Kazutaka Tomimatsu, Kobe (JP); Chikayuki Nagata, Kobe (JP); Morio Kagami, Kobe (JP); Yasutoshi Ueda, Takasago (JP)

(73) Assignee: Mitsusbishi Heavy Industries, Ltd., Tokyo (JP)

( * ) Notice: Subject to any disclaimer, the term of this patent is extended or adjusted under 35 U.S.C. 154(b) by 318 days.

(21) Appl. No.: 10/548,323

(22) PCT Filed: Aug. 26, 2004

(86) PCT No.: PCT/JP2004/012288

§ 371 (c)(1),
(2), (4) Date: Sep. 7, 2005

(87) PCT Pub. No.: WO2005/021161

PCT Pub. Date: Mar. 10, 2005

(65) Prior Publication Data

US 2006/0278082 A1 Dec. 14, 2006

(30) Foreign Application Priority Data

Aug. 29, 2003 (JP) ..... 2003-209808

(51) Int. Cl.
*B03C 3/36* (2006.01)

(52) U.S. Cl. ..... 96/60; 55/DIG. 38; 96/61; 96/64; 96/66; 96/97; 96/98

(58) Field of Classification Search ..... 96/60–66, 96/97, 98; 95/78; 55/DIG. 38
See application file for complete search history.

(56) References Cited

U.S. PATENT DOCUMENTS 512,265 A * 1/1894 Andreoli ..... 422/186.07
1,605,648 A * 11/1926 Cooke ..... 95/79
2,195,431 A * 4/1940 Shively et al. ..... 422/186.04
2,505,907 A * 5/1950 Meston ..... 96/97
3,257,779 A * 6/1966 Strubler ..... 96/54
3,421,050 A * 1/1969 Topper et al. ..... 406/86
3,765,154 A * 10/1973 Hardt et al. ..... 96/88
4,244,710 A * 1/1981 Burger ..... 95/69
4,357,151 A * 11/1982 Helfritch et al. ..... 95/68
4,969,328 A * 11/1990 Kammel ..... 60/275
5,254,155 A * 10/1993 Mensi ..... 96/44

(Continued)

FOREIGN PATENT DOCUMENTS

| | | | | |
|---|---|---|---|---|
| JP | 58-119355 | | 7/1983 | |
| JP | 2-63560 | | 3/1990 | |
| JP | 2-184357 | | 7/1990 | |
| JP | 5-37352 | | 5/1993 | |
| JP | 5-154409 | A * | 6/1993 | ..... 96/97 |
| JP | 2001-38243 | | 2/2001 | |
| JP | 2002-126573 | | 5/2002 | |
| JP | 2003-509615 | | 3/2003 | |
| WO | 01/19525 | | 3/2001 | |

*Primary Examiner*—Richard L. Chiesa
(74) *Attorney, Agent, or Firm*—Wenderoth, Lind & Ponack, L.L.P.

(57) ABSTRACT

An apparatus, which collects particulate matter contained in a gas flowing through a flow path formed in a cylindrical shape having an outer surface and an inner surface, includes: an outer shell that forms the outer surface of the flow path; a ground electrode that forms the inner surface of the flow path; a filter layer that is arranged between the outer shell and the ground electrode; and a discharge electrode that generates, when a voltage is applied, an ion wind inducing a secondary flow toward the ground electrode in a direction transverse to the flow path. The secondary flow passes through the ground electrode and the filter layer having a predetermined aperture ratio.

14 Claims, 13 Drawing Sheets

U.S. PATENT DOCUMENTS 5,474,599 A * 12/1995 Cheney et al. ..... 96/55
6,004,375 A * 12/1999 Gutsch et al. ..... 95/57
6,071,330 A * 6/2000 Matsubara et al. ..... 96/69
6,176,902 B1 * 1/2001 Matsubara ..... 96/66
6,193,782 B1 * 2/2001 Ray ..... 95/4
6,224,653 B1 * 5/2001 Shvedchikov et al. ..... 95/58
6,228,148 B1 * 5/2001 Aaltonen et al. ..... 95/74
6,294,003 B1 * 9/2001 Ray ..... 96/49
6,632,267 B1 * 10/2003 Ilmasti ..... 95/59
6,656,248 B2 * 12/2003 Ilmasti ..... 95/74
2006/0278082 A1 * 12/2006 Tomimatsu et al. ..... 96/66

* cited by examiner

DUST COLLECTOR

This application is the national stage application of International Application No. PCT/JP04/12288, filed on Aug. 26, 2004.

TECHNICAL FIELD

The present invention relates to a dust collecting apparatus that generates a secondary flow, in a flow path through which a gas containing particulate matter flows, by an ion wind in a direction orthogonal to the gas flow, to collect the particulate matter in the gas.

BACKGROUND ART

As a method of collecting and removing the particulate matter from the gas, an electric dust collecting apparatus is well known. The dust collecting apparatus collects the particulate matter charged by corona discharge occurring in the gas onto a dust collection electrode installed in the gas by the Coulomb's force.

Since particles having a large particle diameter have a large charge amount, those particles can be easily collected on the dust collection electrode by the Coulomb's force. However, particles having a small particle diameter are hard to be charged, and hence the Coulomb's force acting thereon is also weak. Furthermore, the particles having a small particle diameter have essentially a property such that the behavior thereof is governed by air flow (particles moves together with the air flow along the stream line of the air flow), and hence, collection thereof by the electric dust collecting apparatus is difficult.

In order to compensate for the above defect, and improve the particle collection characteristics by using the fact that the behavior of particles having a small particle diameter is governed by the air flow, there is a dust collecting apparatus (dust remover) applying the corona discharge. The dust remover includes a discharge electrode provided in the gas flow containing particulate matter, and a counter electrode (ground electrode) arranged opposite to the discharge electrode, wherein a high voltage is applied to between the discharge electrode and the counter electrode. For example, Japanese Patent Application Laid-Open No. H2-63560 (Page 2, left-lower column line 6 to page 3, right-upper column line 19, and FIGS. 1 to 3) describes one in which a wire mesh (mesh) is used as the counter electrode, and a dust removal filter is provided at the opposite side of the discharge electrode, with the counter electrode being put therebetween.

The particulate matter in the gas having flown along the discharge electrode deflects toward the counter electrode due to the Coulomb's force, as a result of being charged. The gas having flown along the discharge electrode is turned in the cross section of the flow path along the gas flow, due to the ion wind generated by a high voltage applied to between the discharge electrode and the counter electrode, and deflects toward the counter electrode. By adjusting a bleeder that adjusts the gas flow rate passing through the dust removal filter and allowing the gas in which the particulate matter deflects to pass through the dust removal filter, dust removal is realized.

Furthermore, for example, Japanese Patent Application Laid-Open No. H2-184357 (Page 3, right-upper column line 19 to page 4, right-upper column line 15, and FIGS. 1 to 6) describes a dust collecting apparatus in which a closed space is provided on the side opposite to the discharge electrode with respect to a filter formed of a counter electrode (ground electrode) and a dust removal filter. The dust collecting apparatus charges the particulate matter in the main gas having flown along the discharge electrode. As a result, the particulate matter deflects toward the counter electrode due to the Coulomb's force. The gas having flown along the discharge electrode flows into the filter in the cross section in the longitudinal direction along the gas flow (main gas flow) due to the ion wind, and is accumulated in the filter and the closed space for some time. The particulate matter in the gas is filtered while the gas is accumulated in the filter and the closed space. In this dust collecting apparatus, since the gas in the closed space is replaced by the gas newly flowing into the filter from the flow path where the gas flows, a bleeder is not required.

For example, Japanese Patent Application National Publication No. 2003-509615 (Paragraphs [00191]to [00291] and FIG. 1) describes a processor having an electric filter and a plurality of serrated plates arranged in a direction transverse to a gas passage, wherein the respective tips of the serrated plates are directed toward a collector (filter) provided along the inner face of a housing. The serrated plates are formed of a star-shaped member, and generate not only corona discharge but also local turbulence. Accordingly, fine particles are accelerated toward the collector in the longitudinal direction (in the direction along the main gas flow).

DISCLOSURE OF THE INVENTION

Problems to be Solved by the Invention

The above three examples indicate methods of guiding the particles to a dust collecting apparatus (a dust collection electrode) by some means other than the Coulomb's force. However, all these methods intend to separate the particulate matter from the main gas in a direction along the main gas flow.

In the first two examples, the particulate matter is guided from the main gas to the dust removal filter by using the ion wind, in the cross section along the main gas flow, regardless of the presence of bleeding. For example, when the flow rate of the main gas is high, it is necessary to generate a very large ion wind in order to generate a secondary flow in the cross section along the main gas flow, overcoming the straight steam line of the main gas.

In other words, it is necessary to obtain a very large corona current by applying a very high voltage. The value of the applied voltage to be required varies according to the configuration of the electrodes, but in any event, there is a limitation on the applicable voltage. That is, there is a limitation on the intensity of the ion wind that can be generated. Therefore, in the case of the dust collecting apparatus in the conventional concept, which uses the secondary flow in the cross section along the main gas flow, the flow rate of the main gas cannot be set high up to the velocity range in which the principle is effective, and hence, realistically, these methods are established only in a low flow rate region.

In the third example, the secondary flow (a means for guiding the particles in the main gas to the dust collecting apparatus) is induced, by generating local turbulence by the star-shaped member. The star-shaped member works as a radiator (the discharge electrode) of the electric filter using the corona discharge. However, the concept in which the corona discharge and the ion wind are used for generating the secondary flow is not specified. When the secondary flow is induced by the local turbulence generated due to a mechanical obstacle, the effect is weak as compared to the case of using the ion wind. Furthermore, since there is no regularity in the turbulence, the effectiveness as a method of using the secondary flow is low.

The present invention has been achieved in order to solve the above problems. It is an object of the present invention to provide a dust collecting apparatus that uses the secondary flow induced by the ion wind for the flow rate of the main gas in a wide range, to convect the gas in the flow path, thereby efficiently collecting the particulate matter contained in the gas.

Means to Solve the Problems

To solve the above problems and achieve the object, a dust collecting apparatus according to an aspect of the present invention includes: an outer shell in a cylindrical shape; a ground electrode that forms a flow path of a gas containing particulate matter provided in the outer shell with a predetermined gap; a dust-collecting filter layer arranged adjacent to the ground electrode in the gap; and a discharge electrode that generates an ion wind inducing and forming a secondary flow in the flow path between the ground electrode and the discharge electrode in a direction orthogonal to the gas, with the tips thereof being away from each other in the direction transverse to the flow path, when a voltage is applied. The ground electrode has an aperture ratio that allows the secondary flow to pass along a cross section of the flow path orthogonal to the gas flow in the flow path. The dust-collecting filter layer has an aperture ratio that allows the secondary flow to pass along the cross section of the flow path orthogonal to the gas flow in the flow path and an aperture ratio that can allow the gas having flown into the dust-collecting filter layer to flow in the direction along the gas flow in the flow path.

Furthermore, the discharge electrode includes a main part of the discharge electrode extending along the flow path, and discharge units of the discharge electrode formed in a thorn shape, extending from a plurality of places on the main part of the discharge electrode toward the ground electrode in the direction transverse to the flow path.

Moreover, the discharge electrode includes main parts of the discharge electrode arranged in a plurality of numbers away from each other in the direction transverse to the flow path and extending along the flow path, and discharge units of the discharge electrode formed in a thorn shape, extending from the main part of the discharge electrode toward the ground electrode.

Moreover, the discharge electrode comprises main parts of the discharge electrode arranged in a plurality of numbers away from each other along the flow path and extending in the direction transverse to the flow path, and discharge units of the discharge electrode formed in a thorn shape, extending from the main part of the discharge electrode toward the ground electrode.

A dust collecting apparatus according to another aspect of the present invention includes an outer shell surrounding an entire flow path through which a gas containing particulate matter flows. A plurality of cells is formed inside the outer shell by partitioning the flow path with a dust-collecting filter layer arranged along the direction of the gas flow. Discharge units of a discharge electrode are arranged in the cell, with the tips thereof being away from each other in a direction transverse to the flow path. At least the dust-collecting filter layer facing the gas flowing in the respective cells and opposite to the tips of the discharge units are covered with a ground electrode. A voltage is applied to between the discharge unit and the ground electrode to generate an ion wind inducing and forming a secondary flow in a direction orthogonal to the gas. The ground electrode has an aperture ratio that allows the secondary flow to pass along a cross section of the flow path orthogonal to the gas flow. The dust-collecting filter layer has an aperture ratio that allows the secondary flow to pass along the cross section of the flow path orthogonal to the gas flow and an aperture ratio that can allow the gas having flown into the dust-collecting filter layer to flow in the direction along the gas flow.

A dust collecting apparatus according to still another aspect of the present invention includes an outer shell surrounding an entire flow path through which a gas containing particulate matter flows. The flow path is formed of a plurality of cells. Ground electrodes are arranged between the adjacent cells so as to face the gas flowing in the respective cells and a dust-collecting filter layer is put between the ground electrodes. Discharge units of a plurality of discharge electrodes that generate an ion wind inducing and forming a secondary flow in a direction orthogonal to the gas, upon application of a voltage to between the ground electrodes and the discharge electrodes are arranged in the flow path, with the tips thereof being away from each other in a direction transverse to the flow path. The ground electrode has an aperture ratio that allows the secondary flow to pass along the cross section of the flow path orthogonal to the gas flow. The dust-collecting filter layer has an aperture ratio that allows the secondary flow to pass along the cross section of the flow path orthogonal to the gas flow and an aperture ratio that can allow the gas having flown into the dust-collecting filter layer to flow in the direction along the gas flow.

Furthermore, a boundary portion between cells adjacent to the outer shell and the outer shell is formed of the ground electrodes arranged to face the gas flowing in the cell, and the dust-collecting filter layer arranged between the ground electrode and the outer shell.

Moreover, the cells are partitioned and formed in a lattice shape by the dust-collecting filter layer.

Moreover, the cells are partitioned and formed in a honeycomb shape by the dust-collecting filter layer.

Moreover, the gas flow is circulated between adjacent cells by the ion wind generated from the tips of the discharge electrodes toward the ground electrodes.

A dust collecting apparatus according to still another aspect of the present invention includes a gas flow path through which a gas containing particulate matter flows; a ground electrode provided along the gas flow path and having an aperture ratio that allows the gas to pass along a cross section of the flow path orthogonal to the gas flow; a dust-collecting filter layer arranged adjacent to the ground electrode and having an aperture ratio that allows the gas to pass along the cross section of the flow path orthogonal to the gas flow and an aperture ratio that allows the gas having flown into the dust-collecting filter layer to flow in the direction along the gas flow in the flow path; and a discharge electrode provided in the flow path with the tip thereof being away from the ground electrode by a predetermined interval. A high voltage is applied to generate an ion wind inducing and forming a secondary flow in a direction orthogonal to the gas from the discharge unit of the discharge electrode to the ground electrode, between the discharge electrode and the ground electrode, thereby generating a helical gas flow between the gas flow path and the dust-collecting filter layer.

Furthermore, the aperture ratio of the ground electrode is set larger than that of the dust-collecting filter layer.

Moreover, the ground electrode has an aperture ratio of from 65% to 85%.

Moreover, the dust-collecting filter layer has a resistance coefficient of pressure loss of from 2 to 300.

Effects Due to the Invention

According to the dust collecting apparatus of the present invention, a ground electrode that forms a flow path of a gas containing particulate matter is provided in an outer shell with a predetermined gap, and a dust-collecting filter layer is provided adjacent to the ground electrode in this gap, while a discharge electrode that can generate an ion wind inducing and forming a secondary flow with respect to the gas is provided in the flow path between the ground electrode and the discharge electrode, by applying a voltage in a state with the tips thereof being away from each other in a direction transverse to the flow path. The ground electrode has an aperture ratio that allows the secondary flow to pass along a cross section of the flow path orthogonal to the gas flow in the flow path, and the dust-collecting filter layer has an aperture ratio that allows the secondary flow to pass along the cross section of the flow path orthogonal to the gas flow in the flow path and an aperture ratio that can allow the gas having flown into the dust-collecting filter layer to flow in the direction along the gas flow in the flow path.

Therefore, particulate matter likely to be charged is attracted to the ground electrode due to an originally strong electrostatic force and collected. However, fine particulate matter hard to be charged flows into the dust-collecting filter layer together with the gas accelerated in the direction orthogonal to the gas flow by the ion wind, though only imperceptible electrostatic force acts thereon, and are collected by the filter layer while passing through the dust-collecting filter layer, though not collected by the ground electrode. As a result, even fine particulate matter hard to be charged, on which only imperceptible electrostatic force acts thereon, which conventionally does not reach a dust-collection electrode and cannot be collected due to the ion wind inverted on the surface of the ground electrode, can be efficiently collected, by convecting the gas flowing in the flow path so as to pass through the ground electrode and the dust-collecting filter layer repetitively.

According to the dust collecting apparatus of the present invention, the discharge electrode has a main part of the discharge electrode extending along the flow path, and discharge units of the discharge electrode formed in a thorn shape, extending from a plurality of places on the main part of the discharge electrode toward the ground electrode in the direction transverse to the flow path. Accordingly, the ion wind is efficiently generated from the discharge units of the discharge electrode toward the ground electrode, thereby enabling appropriate collection of the particulate matter by the dust-collecting filter layer.

According to the dust collecting apparatus of the present invention, the discharge electrode has main parts of the discharge electrode extending along the flow path, and discharge units of the discharge electrode formed in a thorn shape, extending from the main part of the discharge electrode toward the ground electrode, arranged in a plurality of numbers away from each other in the direction transverse to the flow path. Accordingly, design matched with the application portion can be realized by making the direction of the main part of the discharge electrode appropriate, regardless of the arrangement direction of the discharge units of the discharge electrode.

According to the dust collecting apparatus of the present invention, the discharge electrode has main parts of the discharge electrode arranged in a plurality of numbers away from each other in a direction along the flow path and extending in the direction transverse to the flow path, and discharge units of the discharge electrode formed in a thorn shape in a plurality of numbers away from each other, extending from the main part of the discharge electrode toward the ground electrode.

According to the dust collecting apparatus of the present invention, a plurality of cells are formed by partitioning a flow path in an outer shell with a dust-collecting filter layer arranged along the direction of the gas flow, a discharge unit of a discharge electrode is arranged in the cell, with the tips thereof being away from each other in a direction transverse to the flow path, and the dust-collecting filter layer facing the gas flowing in the respective cells and opposite to the tips of the discharge units are covered with a ground electrode. A voltage that generates an ion wind inducing and forming a secondary flow in a direction orthogonal to the gas due to application of a voltage can be applied to between the discharge units and the ground electrode. The ground electrode has an aperture ratio that allows the secondary flow to pass along a cross section of the flow path orthogonal to the gas flow, and the dust-collecting filter layer has an aperture ratio that allows the secondary flow to pass along the cross section of the flow path orthogonal to the gas flow, and an aperture ratio that can allow the gas having flown into the dust-collecting filter layer to flow in the direction along the gas flow. Accordingly, the gas flowing in the flow path in the cell is introduced into the direction transverse to the flow path, and the charged particulate matter flows into the dust-collecting filter layer together with the gas introduced by the ion wind and is collected. As a result, the particulate matter contained in the gas can be efficiently collected.

According to the dust collecting apparatus of the present invention, a flow path in an outer cell is formed of a plurality of cells, ground electrodes are arranged between the adjacent cells so as to face the gas flowing in the respective cells and a dust-collecting filter layer is put between the ground electrodes, and discharge units of a plurality of discharge electrodes that generate an ion wind inducing and forming a secondary flow in a direction orthogonal to the gas, upon application of a voltage to between the ground electrodes and the discharge electrodes, are arranged in the flow path, with the tips thereof being away from each other in a direction transverse to the flow path. The ground electrode has an aperture ratio that allows the secondary flow to pass along the cross section of the flow path orthogonal to the gas flow. The dust-collecting filter layer has an aperture ratio that allows the secondary flow to pass along the cross section of the flow path orthogonal to the gas flow and an aperture ratio that can allow the gas having flown into the dust-collecting filter layer to flow in the direction along the gas flow. Accordingly, the gas flowing in the flow path in the cell is positively accelerated in the direction transverse to the flow path, and the charged particulate matter flows into the dust-collecting filter layer together with the accelerated gas due to the ion wind and is collected. As a result, the particulate matter contained in the gas can be efficiently collected.

According to the dust collecting apparatus of the present invention, a boundary portion between cells adjacent to the outer shell and the outer shell is formed of the ground electrodes arranged so as to face the gas flowing in the cell, and the dust-collecting filter layer arranged between the ground electrode and the outer shell. As a result, the particulate matter contained in the gas can be efficiently collected, regardless of the position of the cell.

According to the dust collecting apparatus of the present invention, since the cell is partitioned and formed in a lattice shape by the dust-collecting filter layer, the cell can be easily formed.

According to the dust collecting apparatus of the present invention, since the cell is partitioned and formed in a honeycomb shape by the dust-collecting filter layer, the surface area of the cell is enlarged to improve the collection efficiency of the particulate matter.

According to the dust collecting apparatus of the present invention, the gas flow is circulated between adjacent cells by the ion wind generated from the tips of the discharge electrodes toward the ground electrodes. As a result, the gas passes through the dust-collecting filter layer for a plurality of times, thereby enabling reliable collection of the particulate matter contained in the gas.

According to the dust collecting apparatus of the present invention, a ground electrode having an aperture ratio that allows the gas to pass along the cross section of the flow path orthogonal to the gas flow is provided along the gas flow path, and a dust-collecting filter layer having an aperture ratio that allows the gas to pass along the cross section of the flow path orthogonal to the gas flow, and an aperture ratio that allows the gas having flown into the dust-collecting filter layer to flow in the direction along the gas flow in the flow path is provided adjacent to the ground electrode. A high voltage is applied to between the discharge electrode and the ground electrode, to generate an ion wind inducing and forming a secondary flow with respect to the gas from discharge units of the discharge electrode to the ground electrode, thereby generating a helical gas flow between the gas flow path and the dust-collecting filter layer. Accordingly, the gas is circulated helically between the gas flow path and the dust-collecting filter layer, and the charged particulate matter flows into the dust-collecting filter layer and is collected, even in the case of fine particles in which the charged amount thereof is small and the electrostatic adhesive force is small. As a result, the particulate matter contained in the gas can be efficiently collected According to the dust collecting apparatus of the present invention, since the aperture ratio of the ground electrode is set larger than that of the dust-collecting filter layer, the particulate matter contained in the gas can be reliably introduced into the dust-collecting filter layer, and the charged particulate matter can be reliably collected by the dust-collecting filter layer.

According to the dust collecting apparatus of the present invention, the ground electrode has an aperture ratio of from 65% to 85%. Accordingly, the ion wind can be reliably introduced into the dust-collecting filter layer, and the minimum area of the ground electrode that can supply a corona current for supplying the ion wind can be ensured.

According to the dust collecting apparatus of the present invention, the dust-collecting filter layer has a resistance coefficient of pressure loss of from 2 to 300. Accordingly, high collection efficiency can be ensured by maintaining the pressure loss of the dust-collecting filter layer at an appropriate value.

DESCRIPTION OF SIGNS

Figure 1:
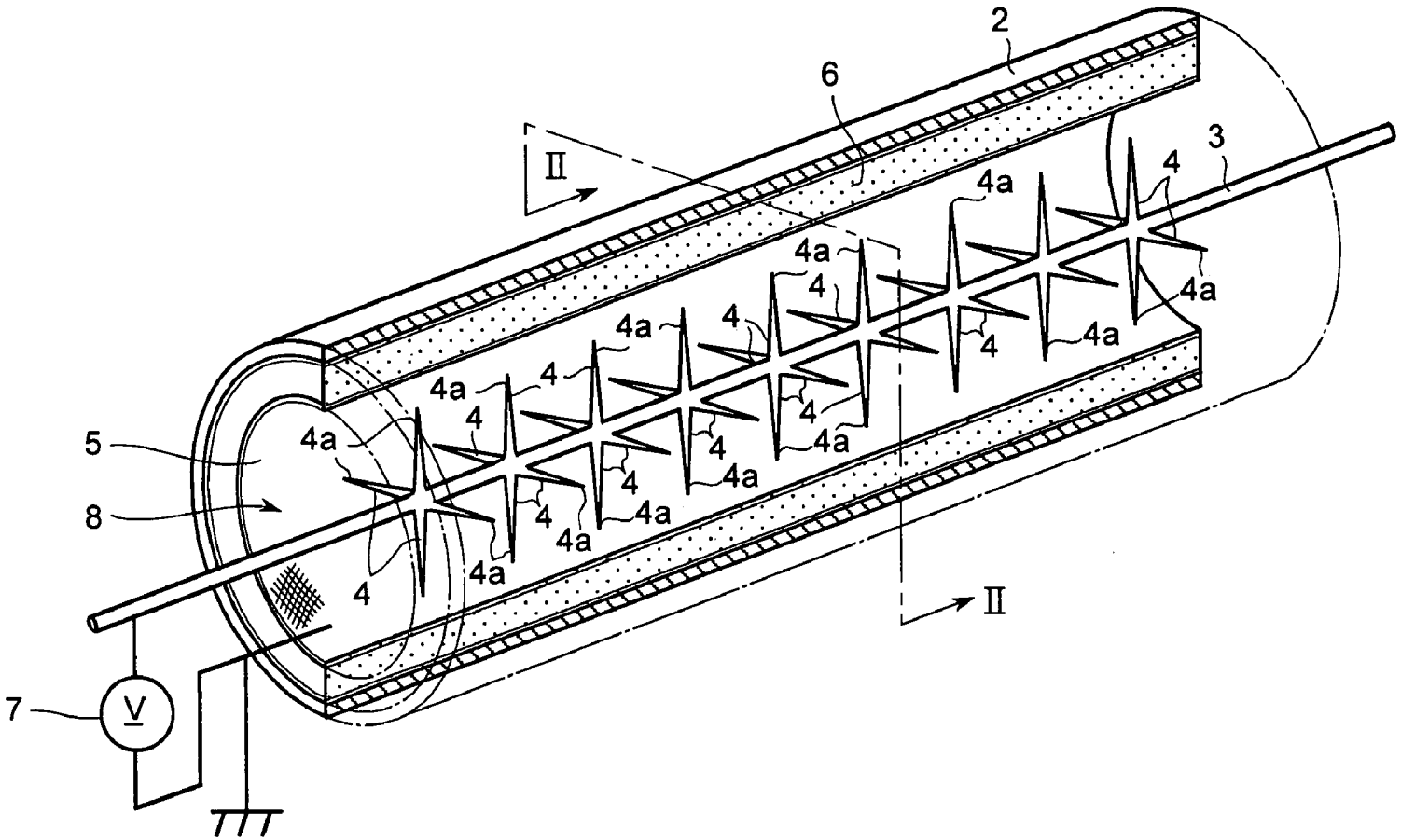
FIG. 1 is a perspective view of a part of a dust collecting apparatus in cross section according to a first embodiment of the present invention.

1 Dust collecting apparatus
2 Outer shell
3 Main part of discharge electrode (discharge electrode)
4 Discharge unit of discharge electrode (discharge electrode)
4*a* Tip
5 Ground electrode
6 Dust-collecting filter layer
7 Power supply
8 Flow path
9 Cell
D Distance between tips of discharge electrode and ground electrode
S Developed length between tips of adjacent discharge electrodes along ground electrode

BEST MODE FOR CARRYING OUT THE INVENTION

Exemplary embodiments of a dust collecting apparatus according to the present invention will be explained in detail with reference to the accompanying drawings. Note that the invention is not limited by the embodiments.

Figure 2:
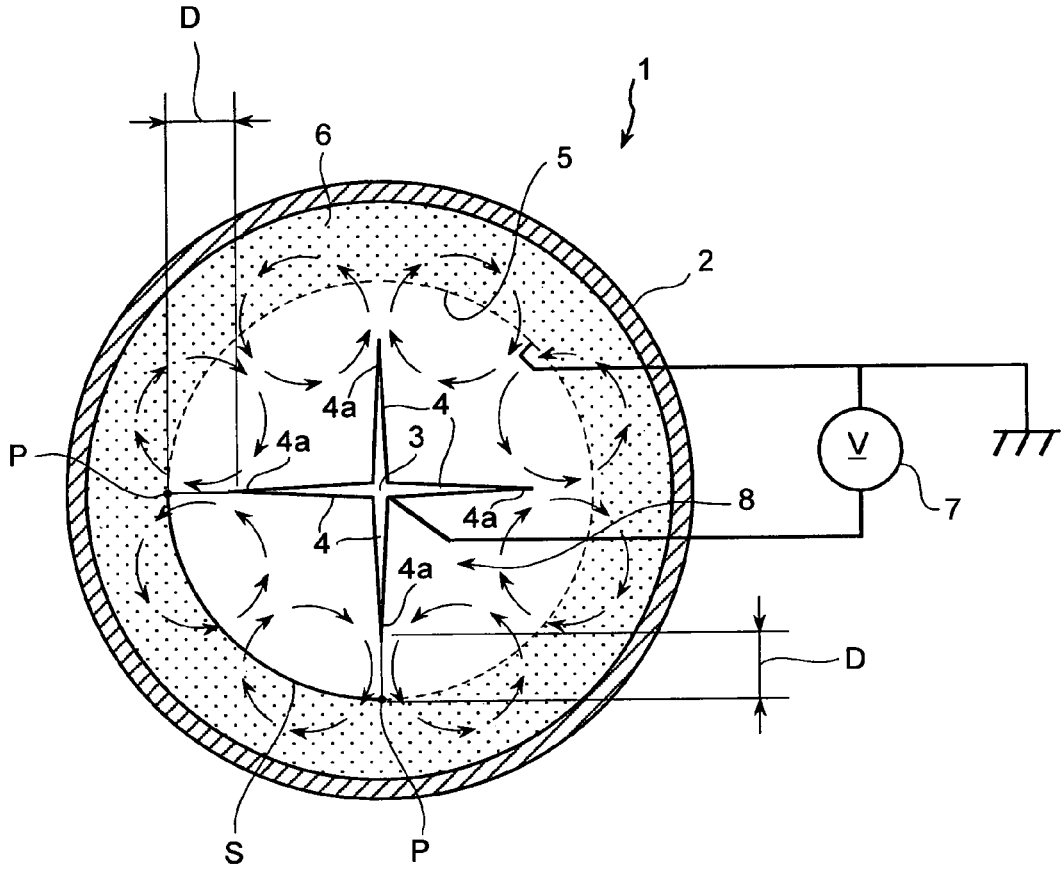
FIG. 2 is a cross section along line II-II in FIG. 1.

FIG. 1 is a perspective view of a part of a dust collecting apparatus according to a first embodiment of the present invention in cross section, and FIG. 2 is a cross section along the line II-II in FIG. 1.

In the first embodiment, as shown in FIGS. 1 and 2, a dust collecting apparatus 1 includes an outer shell 2, a discharge electrode that becomes a main part 3 or a discharge unit 4, a ground electrode 5, a dust-collecting filter layer 6, and a power supply 7.

The outer shell 2 is in a cylindrical shape, and forms a flow path 8 through which a gas containing particulate matter therein flows. The main part 3 of the discharge electrode extending along the direction of a flow path is arranged at the center of the flow path 8. The discharge unit 4 of the discharge electrode is formed in a thorn shape extending from the main part 3 of the discharge electrode toward the ground electrode 5 in a direction transverse to the flow path 8.

Tips 4*a* of the discharge units 4 of the discharge electrode are away from each other in the direction transverse to the flow path 8. Specifically, it is preferred that a distance S between a node P of a perpendicular brought down from the tip 4*a* of the discharge unit 4 of the discharge electrode to the opposite dust collection electrode and a node P of a perpendicular brought down from the tip 4*a* of the adjacent discharge unit 4 of the discharge electrode be from 0.8D to 3D inclusive. In the first embodiment, four discharge units 4 are provided radially from the same position on the main part 3 of the discharge electrode, and provided likewise at a plurality of positions on the main part 3 of the discharge electrode. When the distance S is less than 0.8D, since the corona current cannot be sufficiently ensured due to interference between adjacent discharge units 4 of the discharge electrode, sufficient ion wind cannot be generated. Furthermore, the ion wind itself cannot function sufficiently due to the mutual intervention. On the other hand, when the distance S is larger than 3D, since an area in which the ion wind does not act effectively (dead space) increases, the performance of the dust collecting apparatus 1 decreases.

In a conventional dust collecting apparatus, since the particulate matter in the gas is collected on the surface of the ground electrode, expression of ground electrode=dust collection electrode is used. On the other hand, in the first embodiment, the ground electrode and the dust collection electrode are used separately.

In the dust collecting apparatus 1 according to the first embodiment, a high voltage is applied to the discharge electrode, to generate the ion wind induced by ions rushing out from the discharge units 4 of the discharge electrode toward the ground electrode 5. In this case, the ground electrode 5 is formed by using a material having a large aperture ratio. Therefore, it has a function of collecting a part of the particulate matter contained in the gas, but in practice, the most part of the particulate matter contained in the gas passes by the ground electrode 5. The particulate matter contained in the gas is guided to the dust-collecting filter layer 6 arranged outside of the ground electrode 5, together with the gas, and the most part thereof is collected by the dust-collecting filter layer 6. Thus, the dust collecting apparatus 1 attracts the particulate matter together with the gas, and collects the particulate matter by the dust-collecting filter layer 6. Therefore, the ground electrode 5 is discriminated from the dust collection electrode herein.

The ground electrode 5 is provided inside of the outer shell 2 away from the tips 4*a* of the respective discharge units 4 of the discharge electrode by the same distance D. For the ground electrode 5, a conductive net having an aperture ratio that allows the particulate matter to pass, specifically, a conductive material such as a wire net is used. Any conductive material having an aperture ratio sufficient for allowing the particulate matter to pass therethrough, for example, a wire net in which a wire is woven in a plain weave, a punching metal, or an expanded metal can be used.

The ground electrode 5 can be a conductive film provided with a minute opening by etching, or a netlike metal foil formed by electrocasting, other than the wire net. When using a plainly woven wire net, the thickness of the wire forming the wire net is selected so as not to be too thin, in order that the electric field does not localized.

For example, when the dust collecting apparatus 1 is applied to recover the particulate matter contained in the exhaust gas of a diesel engine, it has been found from an experiment that by setting the aperture ratio of the ground electrode 5 to 65 to 85%, the collection efficiency of the particulate matter contained in the gas can be considerably improved, as compared to a case of the aperture ratio being 50%.

The dust-collecting filter layer 6 is provided between the ground electrode 5 and the outer shell 2. The dust-collecting filter layer 6 has a moderate aperture ratio in the direction along the cross section of the flow path transverse to the gas flow, so that the secondary flow can act effectively on the cross section orthogonal to the gas flow, and has a configuration having an aperture ratio also in the direction along the gas flow in the flow path 8. That is, it is necessary that the gas led to the dust-collecting filter layer 6 can move in the same direction as that of the main gas flowing in the flow path 8, in order to ensure two-dimensional circulation of the flow in a direction perpendicular to the gas flow in the flow path 8.

Since the dust-collecting filter layer 6 has an aperture ratio in a vectorial direction of the main gas flow, the gas containing the particulate matter circulates while rotating three-dimensionally and helically along the gas flow, between the flow path 8 through which the main gas flows and the dust-collecting filter layer 6, by the secondary flow led from the main gas to the dust-collecting filter layer 6. The particulate matter having an electric charge and contained in the gas is mechanically and electrostatically collected in the dust-collecting filter layer 6 during being circulated.

The dust-collecting filter layer 6 is made of a porous material through which the gas can pass, regardless of being conductive or nonconductive, which collects the particulate matter contained in the gas. Various materials having gas permeability such as a laminated wire net, porous ceramics, and a filler made of glass fiber can be used as the material for the dust-collecting filter layer 6. According to conditions such as temperature or component of the target gas, it is necessary to take into consideration the heat resistance of the material used as the dust-collecting filter layer 6, and also conditions such as use atmosphere with respect to corrosion should be taken into consideration in selection of the material for the dust-collecting filter layer 6.

The thickness of the dust-collecting filter layer 6 should be determined by a pressure loss of the dust-collecting filter layer 6 and required dust collection performance. It is preferred that the pressure loss that the gas suffers be as low as possible, though it is also related to the porosity of the material to be used. Therefore, a relatively thin material is used. However, in order to make the secondary flow pattern in the cross section orthogonal to the main gas effective, and make the convection current between the portion where the dust-collecting filter layer 6 is installed and the flow path 8 through which the main gas flows effective, the distance between the ground electrode 5 and the outer shell 2 is required to some extent.

That is, in the first embodiment, such state that the dust-collecting filter layer 6 is substantially filled in the space between the ground electrode 5 and the outer shell 2 is exemplified. However, according to the use condition, there may be a case in which the thickness of the dust-collecting filter layer 6 should be set thinner than the distance between the ground electrode 5 and the outer shell 2. In this case, there may be a space between the dust-collecting filter layer 6 arranged adjacent to the ground electrode 5 and the outer shell 2.

The one side of the power supply 7 is connected to the main part 3 of the discharge electrode and the other side is connected to the ground electrode 5, to apply a high voltage to between the discharge unit 4 of the discharge electrode and the ground electrode 5. In this case, the power supply 7 connects the discharge unit 4 of the discharge electrode side to the negative pole to ground the ground electrode 5. Since the discharge unit 4 of the discharge electrode is connected to the negative pole, gaseous molecules of the gas is ionized near the starting tip of the corona discharge caused at the tip 4*a* of the discharge unit 4 of the discharge electrode.

The ionized gaseous molecules flow in the flow path 8, involving the surrounding gas, from the tip 4*a* of the discharge unit 4 of the discharge electrode toward the ground electrode 5, while moving due to the electric field. As a result, the secondary flow of the gas is formed by the ion wind in the cross section orthogonal to the main gas flow and blown upon the ground electrode 5.

Therefore, the gas flowing in the flow path 8 is accelerated by the ion wind toward the ground electrode 5, passes through the ground electrode 5, and flows into the dust-collecting filter layer 6. The particulate matter contained in the gas having flown into the dust-collecting filter layer 6 is collected while the gas is flowing in the dust-collecting filter layer 6, and the gas returns into the flow path 8 via the ground electrode 5 again from a position between the positions against which the ion wind is blown by the adjacent discharge units 4 of the discharge electrode.

If the distance S between the tips 4*a* of the discharge units 4 of the discharge electrode in the cross section orthogonal to the main gas flow is made short, as compared to the distance between the tips 4*a* of the adjacent discharge units 4 of the discharge electrode in the longitudinal cross section along the flow path 8, the secondary flow due to the ion wind in the cross section orthogonal to the main gas flow becomes noticeable (vigorous) as compared to the secondary flow due to the ion wind in the longitudinal cross section along the main gas flow. Since a plurality of discharge units 4 of the discharge electrode is provided on the main part 3 of the discharge electrode, the gas flowing in the dust collecting apparatus 1 is circulated so as to pass through the dust-collecting filter layer 6 repetitively in the direction transverse to the flow path 8 due to the ion wind in the respective cross sections orthogonal to the main gas flow. As a result, the gas having flown along the flow path 8 flows helically in the flow path 8 by being convected by the ion wind.

Therefore, since the gas is efficiently collected by the dust-collecting filter layer even in the flow path 8 having the same length as that of the conventional flow path, the collection efficiency of the particulate matter is improved. That is, if the dust collecting apparatus 1 having the same performance is used, the flow path 8 can be made short, and hence, the dust collecting apparatus 1 can be made smaller.

Thus, in the dust collecting apparatus 1 according to the first embodiment, it is noted that the dust collection performance can be considerably improved in a cross section of the flow path orthogonal to the main gas flow, by using the fact that the influence of the main gas flow is little, and the secondary flow due to the ion wind can be generated in the cross section of the flow path orthogonal to the main gas flow. The dust collecting apparatus 1 charges the particulate matter to collect the particulate matter onto the ground electrode 5 due to the electrostatic force, and allows the gas flowing in the flow path 8 to be convected by the ion wind as shown by arrow in FIG. 2, and to pass through the dust-collecting filter layer 6 repetitively, thereby enabling collection of the particulate matter having fine particle diameters, which is hard to be charged, more efficiently in the dust-collecting filter layer 6. As a result, the dust collecting apparatus 1 can collect the particulate matter efficiently.

Figure 3:
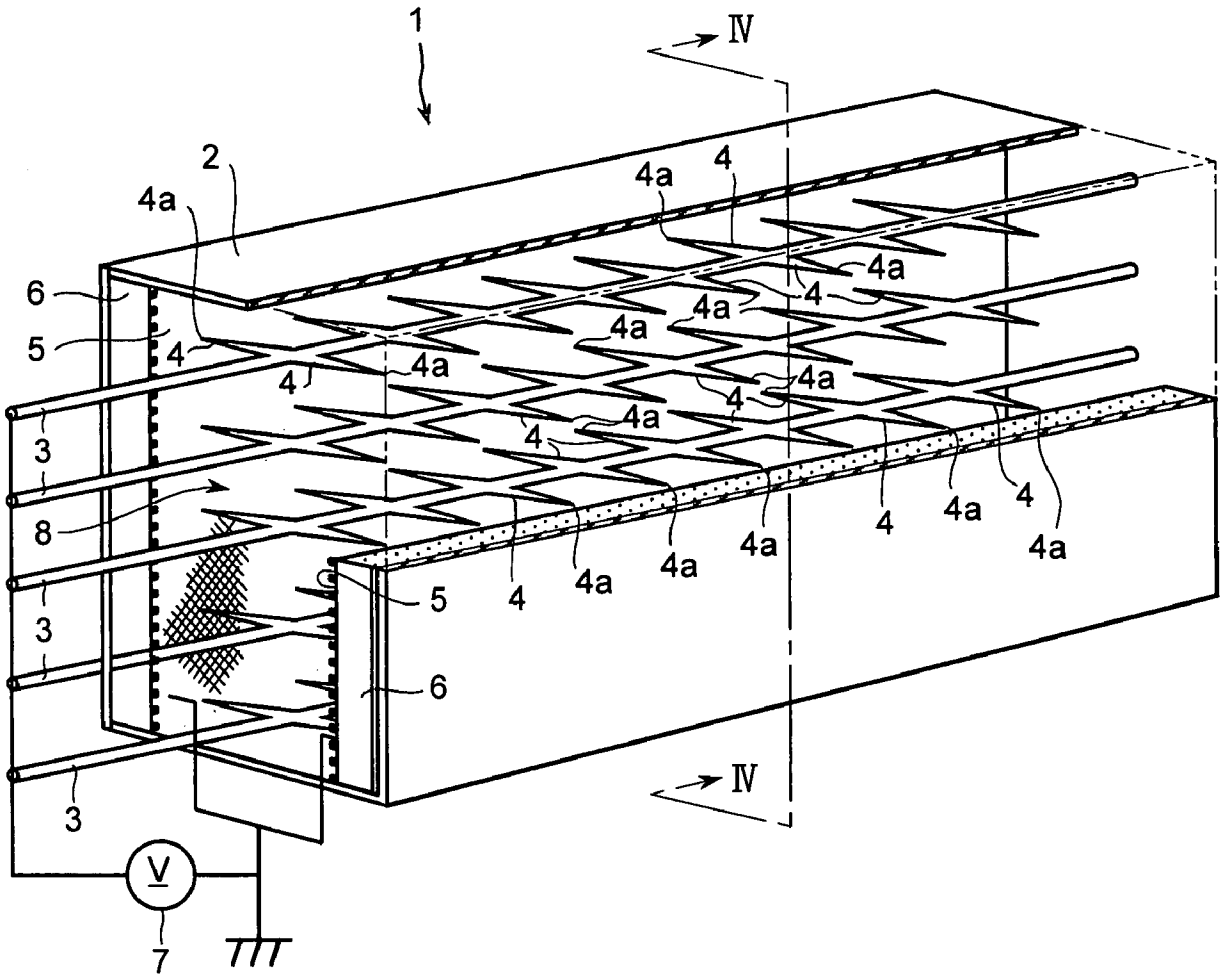
FIG. 3 is a perspective view of a part of the dust collecting apparatus in cross section according to a second embodiment of the present invention.
Figure 4:
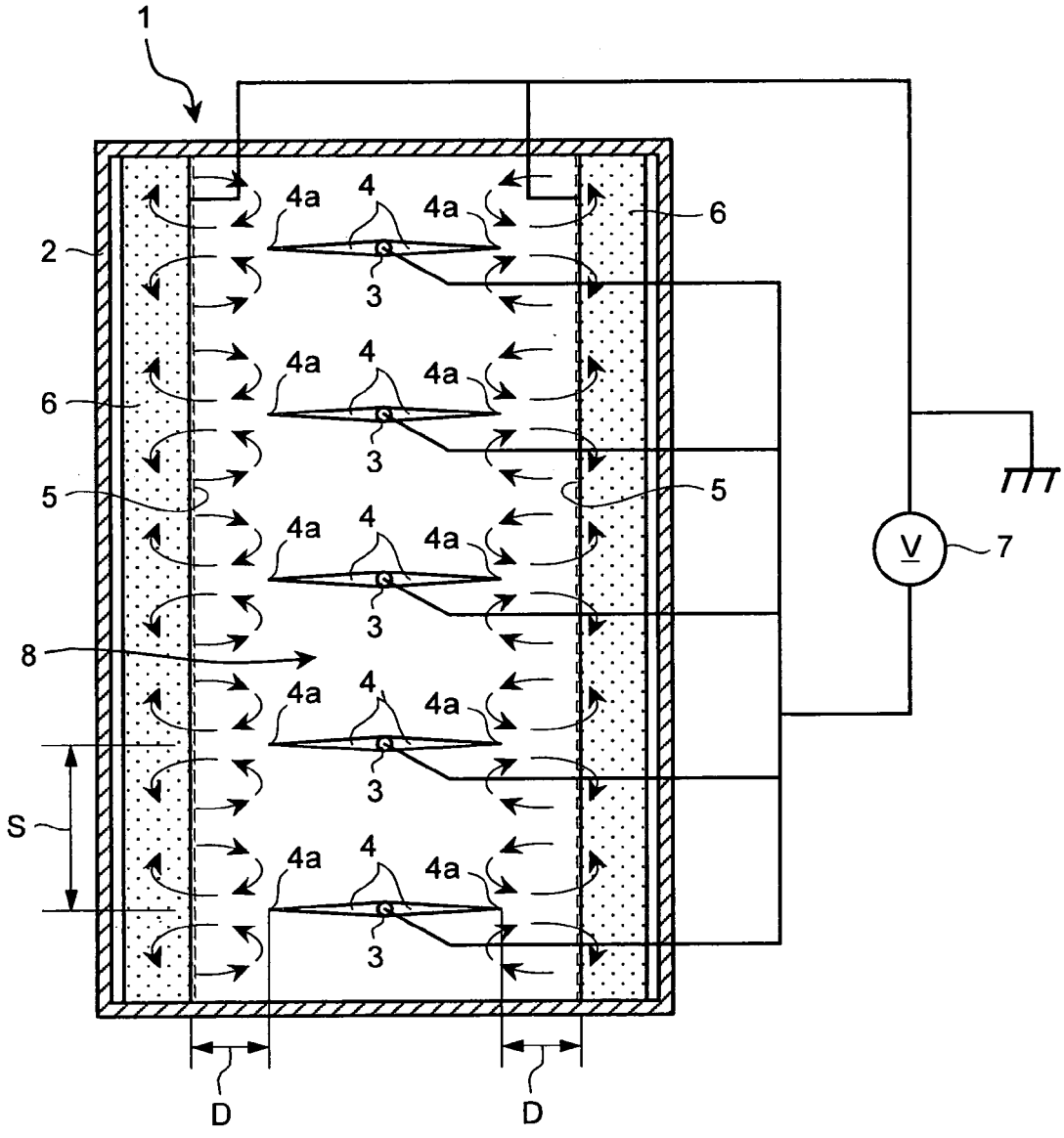
FIG. 4 is a cross section along line IV-IV in FIG. 3.

FIG. 3 is a perspective view of a part of the dust collecting apparatus according to a second embodiment of the present invention in cross section, and FIG. 4 is a cross section along the line IV-IV in FIG. 3. Like reference signs are designated with like members having the same functions as in the first embodiment, and the redundant explanation is omitted.

In the second embodiment, as shown in FIGS. 3 and 4, the dust collecting apparatus 1 includes a plurality of main parts 3 of the discharge electrode. These main parts 3 of the discharge electrode are arranged away from each other in the direction transverse to the flow path 8, and extend along the flow path 8. The main parts 3 of the discharge electrode are arranged in a row in the direction transverse to the flow path 8. The ground electrodes 5 are arranged in parallel with the discharge electrodes, with the row of the main parts 3 of the discharge electrode put therebetween.

The discharge units 4 of the discharge electrode are formed in a thorn shape extending from the respective main parts 3 of the discharge electrode toward the ground electrodes ground electrode 5 on the opposite sides, and provided at a plurality of positions on the respective main parts 3 of the discharge electrode. The tips 4*a* of the discharge units 4 of the discharge electrode provided on the adjacent main parts 3 of the discharge electrode are arranged away from each other in the direction transverse to the flow path 8. Specifically, it is preferred that the tips 4*a* of the discharge units of the discharge electrode be arranged so that the distance S between the nodes of perpendiculars brought down from the tips 4*a* of the discharge units 4 to the ground electrode 5 be in a range of from 0.8 to 3D, with respect to the distance D between the tips 4*a* of the discharge units 4 of the discharge electrode and the ground electrode 5. The power supply 7 is provided so as to apply the same voltage to between the respective main parts 3 of the discharge electrode and the ground electrodes 5 on the opposite sides thereof.

When the gas containing the particulate matter flows into the flow path 8, the dust collecting apparatus 1 formed as described above allows the gas flowing in the flow path 8 to be convected by the ion wind generated from the tips 4*a* of the discharge units 4 of the discharge electrode toward the ground electrodes 5 in the direction transverse to the flow path 8, as shown by arrow in FIG. 4, as in the dust collecting apparatus 1 according to the first embodiment. Since the dust collecting apparatus 1 can make the gas pass through the dust-collecting filter layer 6 repetitively, the dust collecting apparatus 1 can collect the particulate matter efficiently.

In the second embodiment, a state that the dust-collecting filter layer 6 fills the entire space between the ground electrodes 5 and the outer shell 2 is shown. However, due to the same reason explained in the first embodiment, it may be necessary to set the thickness of the dust-collecting filter layer 6 to be thinner than the distance between the ground electrode 5 and the outer shell 2, according to the use conditions. In such a case, there may be a space between the dust-collecting filter layer 6 arranged adjacent to the ground electrode 5 and the outer shell 2.

Figure 5:
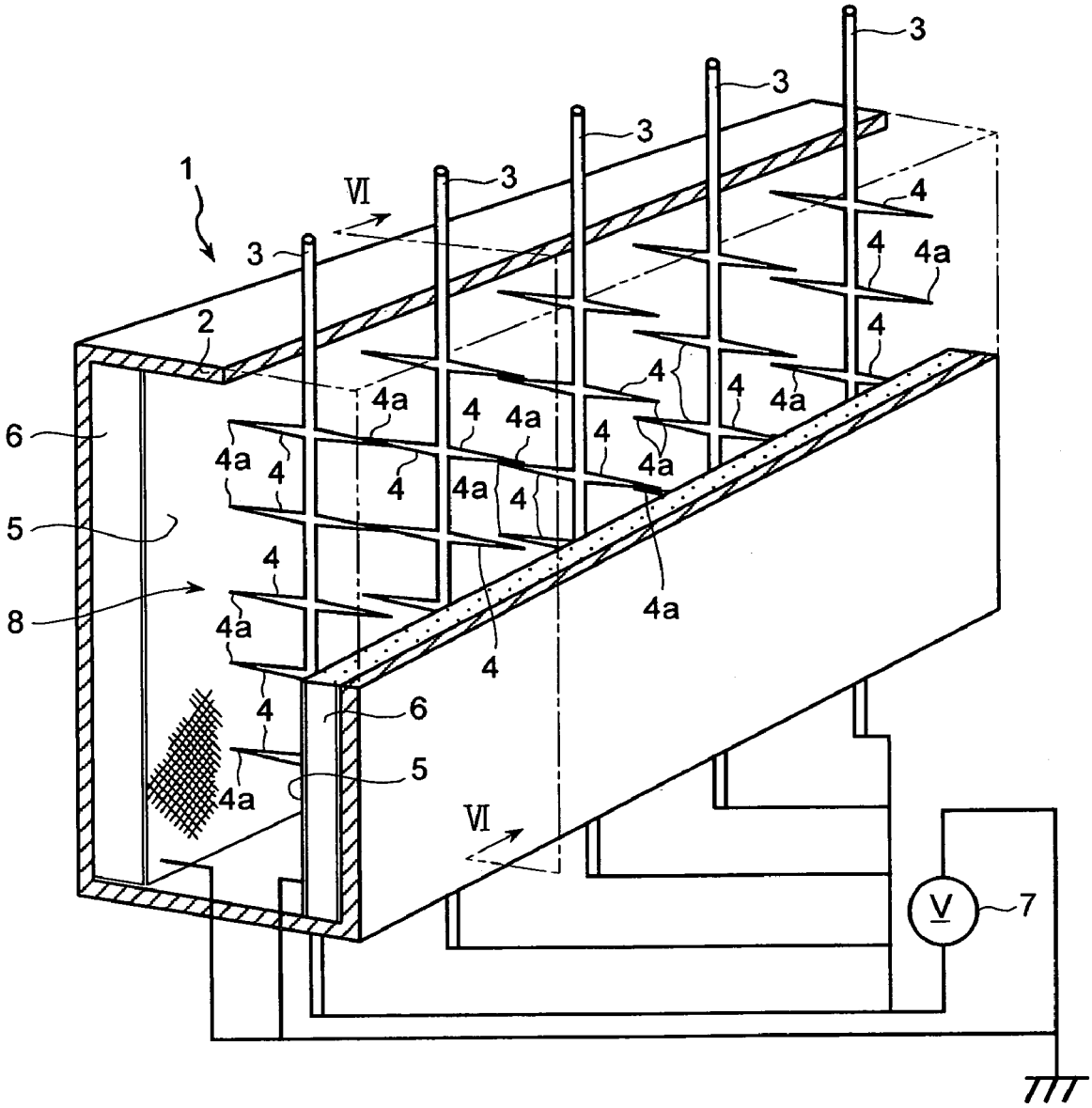
FIG. 5 is a perspective view of a part of the dust collecting apparatus in cross section according to a third embodiment of the present invention.
Figure 6:
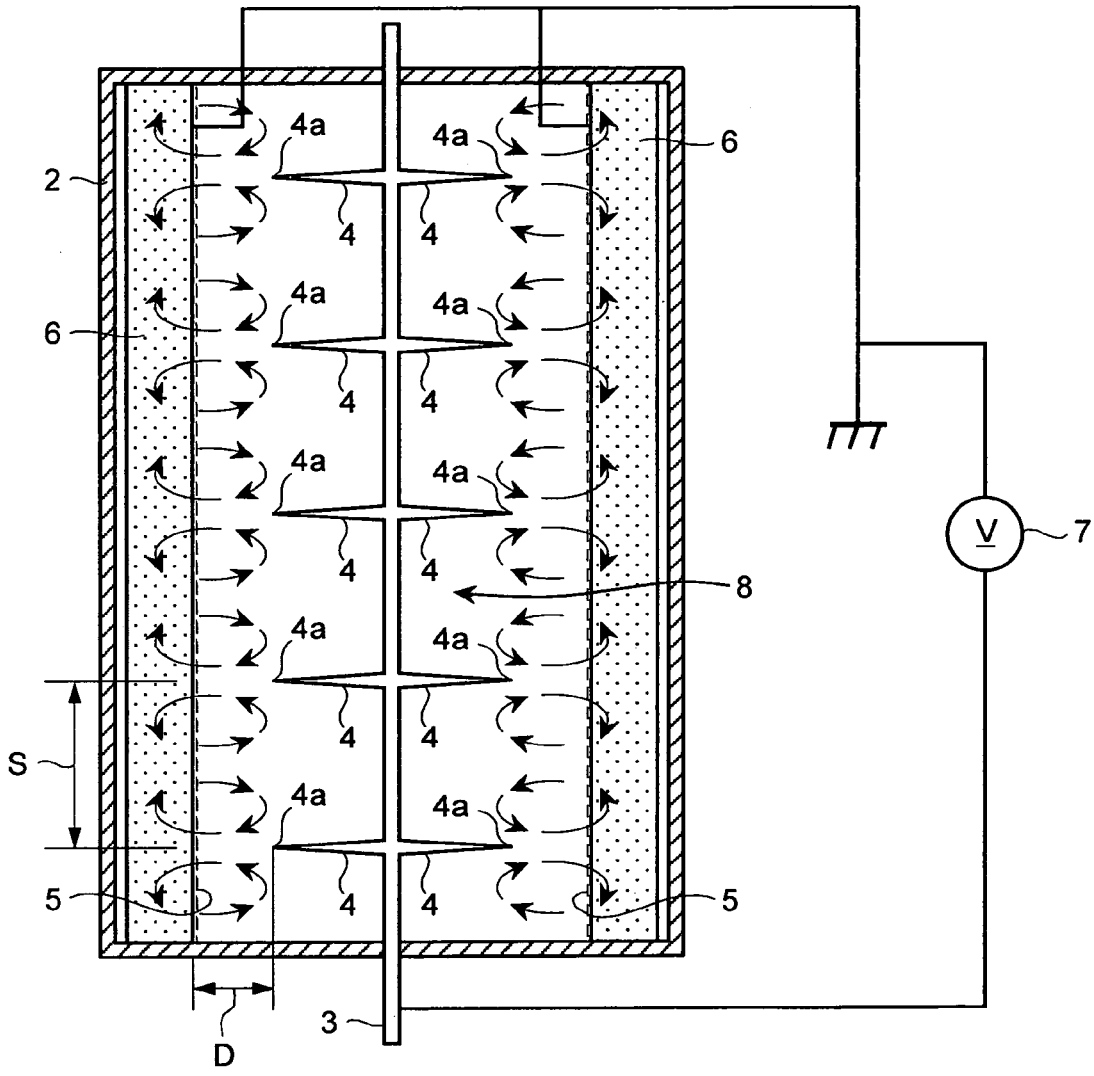
FIG. 6 is a cross section along line VI-VI in FIG. 5.

FIG. 5 is a perspective view of a part of the dust collecting apparatus according to a third embodiment of the present invention in cross section, and FIG. 6 is a cross section along the line VI-VI in FIG. 5. Like reference signs are designated with like members having the same function as in the above embodiments and the redundant explanation is omitted.

In the third embodiment, as shown in FIGS. 5 and 6, the dust collecting apparatus 1 includes a plurality of main parts 3 of the discharge electrode as in the dust collecting apparatus 1 according to the second embodiment. These main parts 3 of the discharge electrode are arranged away from each other in the direction along the flow path 8, and extend in the direction transverse to the flow path 8. The discharge units 4 of the discharge electrode extending from the main part 3 of the discharge electrode toward the ground electrodes are provided at a plurality of positions on the respective main parts 3 of the discharge electrode.

It is preferred that the tips 4*a* of the discharge units of the discharge electrode be arranged so that the distance S between the nodes of perpendiculars brought down from the tips 4*a* of the discharge units 4 to the ground electrode 5 be in a range of from 0.8 to 3D, with respect to the distance D between the tips 4*a* of the discharge units 4 of the discharge electrode and the ground electrode 5.

In the third embodiment, a state that the dust-collecting filter layer 6 fills the entire space between the ground electrodes 5 and the outer shell 2 is shown. However, due to the same reason explained in the first embodiment, it may be necessary to set the thickness of the dust-collecting filter layer 6 to be thinner than the distance between the ground electrode 5 and the outer shell 2, according to the use conditions. In such a case, there may be a space between the dust-collecting filter layer 6 arranged adjacent to the ground electrode 5 and the outer shell 2.

The respective main parts 3 of the discharge electrode in the dust collecting apparatus 1 according to the third embodiment are insulated and supported at two positions penetrating the outer shell 2 that forms the flow path 8, while the main parts 3 of the discharge electrode in the dust collecting apparatus 1 according to the first and the second embodiments are supported at a position derived to the outside of the outer shell 2 respectively on the upper and lower stream sides of the flow path 8. The positions of the discharge units 4 of the discharge electrode provided on the adjacent main parts 3 of the discharge electrode are arranged in the direction of the flow path 8.

The dust collecting apparatus 1 formed as described above allows the gas containing the particulate matter to be convected, as sown by arrow in FIG. 6, in the direction transverse to the flow path 8, as in the dust collecting apparatus 1 according to the second embodiment. As a result, the gas flows helically in the flow path 8. Since the dust collecting apparatus 1 can make the gas pass through the dust-collecting filter layer 6 repetitively, the dust collecting apparatus 1 can collect the particulate matter efficiently. Furthermore, since the discharge units 4 of the discharge electrode are provided on the main parts 3 of the discharge electrode extending in the direction transverse to the flow path 8, the distance S between the tips 4*a* of the discharge units 4 of the discharge electrode can be easily set in the direction transverse to the flow path 8. The distance between the discharge units 4 of the discharge electrode can be easily reset in the direction along the flow path 8 according to the flow rate of the gas that flows in the flow path 8.

Figure 7:
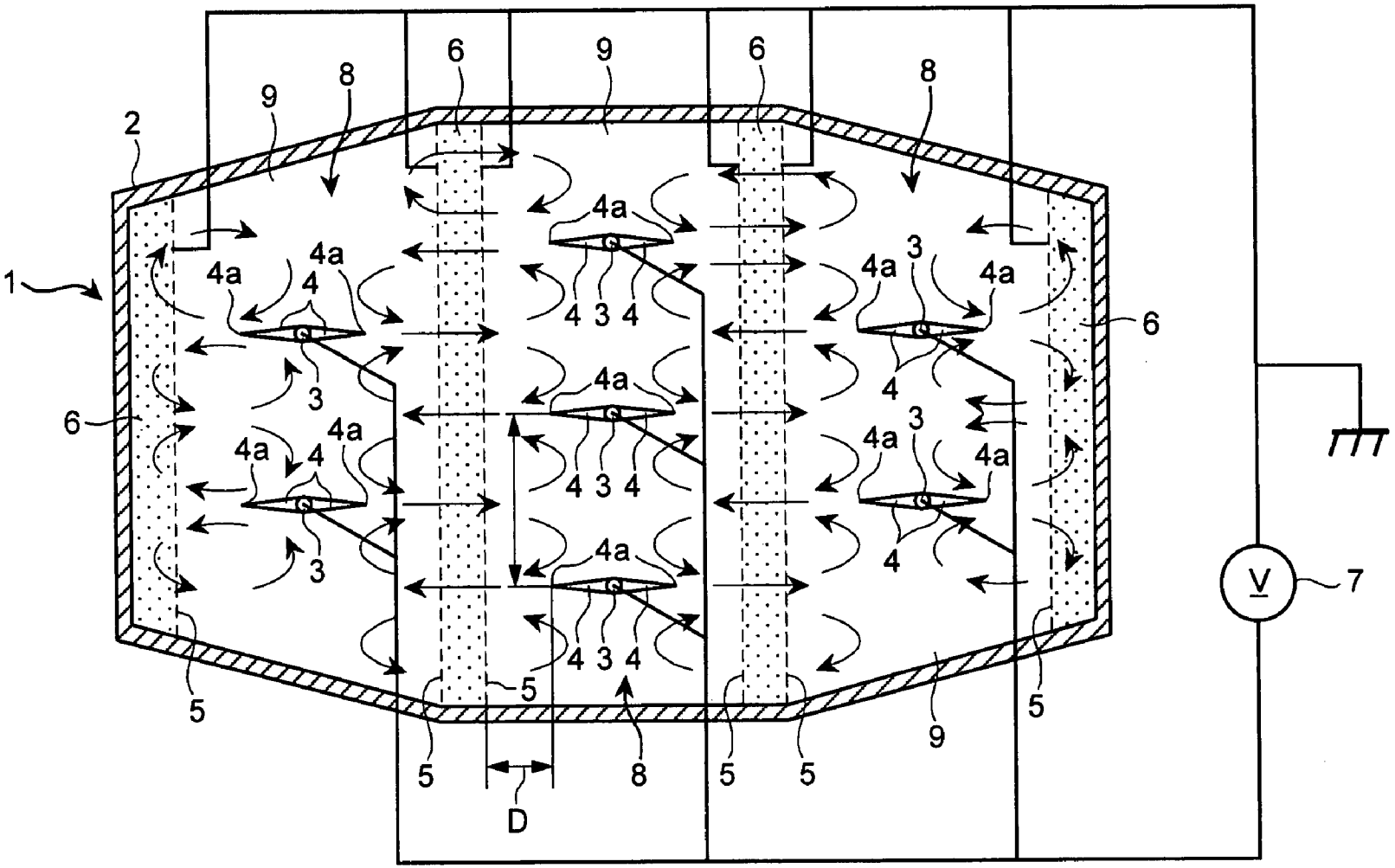
FIG. 7 is a cross section across a flow path in the dust collecting apparatus according to a fourth embodiment of the present invention.

FIG. 7 is a cross section in a direction transverse to the flow path in the dust collecting apparatus according to a fourth embodiment of the present invention. Like reference signs are designated with like members having the same functions as in the embodiments explained above and the redundant explanation is omitted.

In the fourth embodiment, as shown in FIG. 7, the dust collecting apparatus 1 includes a plurality of main parts 3 of the discharge electrode extending along the flow path, away from each other in the direction transverse to the flow path 8. The flow path 8 in the dust collecting apparatus 1 is divided into three cells 9 by the dust-collecting filter layer 6 arranged in parallel, and three main parts 3 of the discharge electrode are arranged in the central cell 9, and two main parts 3 of the discharge electrode are arranged in the right and left cells 9. Therefore, in the dust collecting apparatus 1, the flow path 8 is divided into the cells 9 by the dust-collecting filter layer 6, and at least one main part 3 of the discharge electrode is arranged in the respective cells 9.

The gas can pass through the dust-collecting filter layer 6 that separates the adjacent cells 9, in any direction. That is, the dust collecting apparatus 1 corresponds to a shape in which the inside part from the dust-collecting filter layer 6 of the dust collecting apparatus 1 according to the second embodiment is arranged in a plurality of numbers, adjacent to each other, with the dust-collecting filter layer 6 put therebetween, and is covered with one outer shell 2.

The ground electrode 5 is arranged between the dust-collecting filter layer 6 that separates the adjacent cells 9 and the tips 4*a* of the discharge units 4 of the discharge electrode. The power supply 7 is connected to the respective ground electrodes 5 and the respective main parts 3 of the discharge electrode, to apply voltage from the discharge units 4 of the discharge electrode toward the ground electrodes 5 to generate the ion wind.

The direction indicated by the tips 4*a* of the discharge units 4 of the discharge electrode arranged in the adjacent cells 9 is shifted from the direction opposite to each other in the direction transverse to the flow path 8. Specifically, the tips 4*a* of the discharge units 4 of the discharge electrode in the adjacent cells 9 are oriented to between the tips 4*a* of the discharge units 4 of the discharge electrode arranged in the adjacent cell 9 in the direction transverse to the flow path 8. That is, the tip 4*a* of the discharge unit 4 of the discharge electrode arranged in the adjacent cell 9 is situated at a position shifted by half pitch with respect to the distance (pitch) S between the tips 4*a* of the discharge units 4 of the discharge electrode arranged in the same cell 9.

It is preferred that the distance S between the nodes of perpendiculars brought down from the tips 4*a* of the discharge units 4 of the adjacent discharge electrodes to the ground electrode 5 in the direction transverse to the flow path 8 in the same cell 9 be in a range of from 0.8 to 3D, with respect to the distance D between the tips 4*a* of the discharge units 4 of the discharge electrodes and the ground electrode 5, as in the other embodiments. Therefore, when there is one main part 3 of the discharge electrode respectively, in the adjacent cells 9, the tips 4*a* of the discharge units of the respective discharge electrodes are arranged at positions away from each other by the distance D between the tip 4*a* of the discharge unit 4 of the discharge electrode and the ground electrode 5 or larger in the direction transverse to the flow path 8.

The discharge unit 4 of the discharge electrode is provided at a plurality of positions on the main part 3 of the discharge electrode as in the discharge unit 4 of the discharge electrode according to the second embodiment. In this case, the discharge units 4 of the discharge electrodes are arranged at the same positions on the main parts of the discharge electrodes in the direction along the flow path 8, between the adjacent main parts 3 of the discharge electrodes in the same cell 9 and in the main parts 3 of the discharge electrodes in the adjacent cell 9.

The dust collecting apparatus 1 formed in the above manner charges the particulate matter in the gas by the corona discharge generated from the tips 4*a* of the discharge units 4 of the discharge electrode, to attract the particulate matter contained in the gas to the ground electrode 5, when the gas containing the particulate matter flows in the flow path 8. The gas is accelerated toward the ground electrode 5 by the ion wind generated from the tips 4*a* of the discharge units 4 of the discharge electrodes toward the ground electrodes 5. The gas accelerated in the direction transverse to the flow path 8 passes through the ground electrode 5 and flows into the dust-collecting filter layer 6. Since the dust-collecting filter layer 6 that divides the adjacent cells 9 allows the gas to pass in any direction, the gas entering into the dust-collecting filter layer 6 flows into the adjacent cell 9.

In the cell 9 to which the gas enters, the discharge units 4 of the discharge electrode are provided at positions shifted from positions into which the gas has flown, that is, at positions shifted from positions facing the discharge units 4 of the discharge units 4 in the adjacent cell 9, or toward between the positions where the discharge units 4 of the discharge units 4 in the adjacent cell 9 are situated. The ion wind is generated likewise from the discharge units 4 of the discharge electrode in the cell 9 into which the gas has flown. The gas flows out to the adjacent cell 9 from between the positions shifted from the position into which the gas has flown from the adjacent cell 9 or from between the positions into which the gas has flown, due to the ion wind.

In other words, as shown by arrow in FIG. 7, the gas is circulated between the adjacent cells 9 by the ion wind generated from the discharge units 4 of the discharge electrodes. Thus, since the gas is circulated in the direction transverse to the flow path 8, the gas can pass through the dust-collecting filter layer 6 repetitively. Accordingly, the collection efficiency is improved, even for the particulate matter that is not attracted to the ground electrode 5 by the electrostatic force. Furthermore, since the positions where the gas flows into the cell 9 from the other cell 9 are provided alternately, the gas flow can be efficiently circulated and stirred, and hence, the probability of allowing the particulate matter contained in the gas to pass through the dust-collecting filter layer 6 is high. That is, the particulate matter can be efficiently collected.

In the fourth embodiment, a state that the dust-collecting filter layer 6 arranged on the outer shell 2 side of the cells 9 on the left and right ends fills the entire space between the ground electrode 5 and the outer shell 2 is shown. However, due to the same reason explained in the other embodiments, the thickness of the dust-collecting filter layer 6 may be set to be thinner than the distance between the ground electrodes 5 and the outer shell 2, according to the use conditions. In such a case, there may be a space between the dust-collecting filter layer 6 arranged adjacent to the ground electrode 5 and the outer shell 2.

Figure 8:
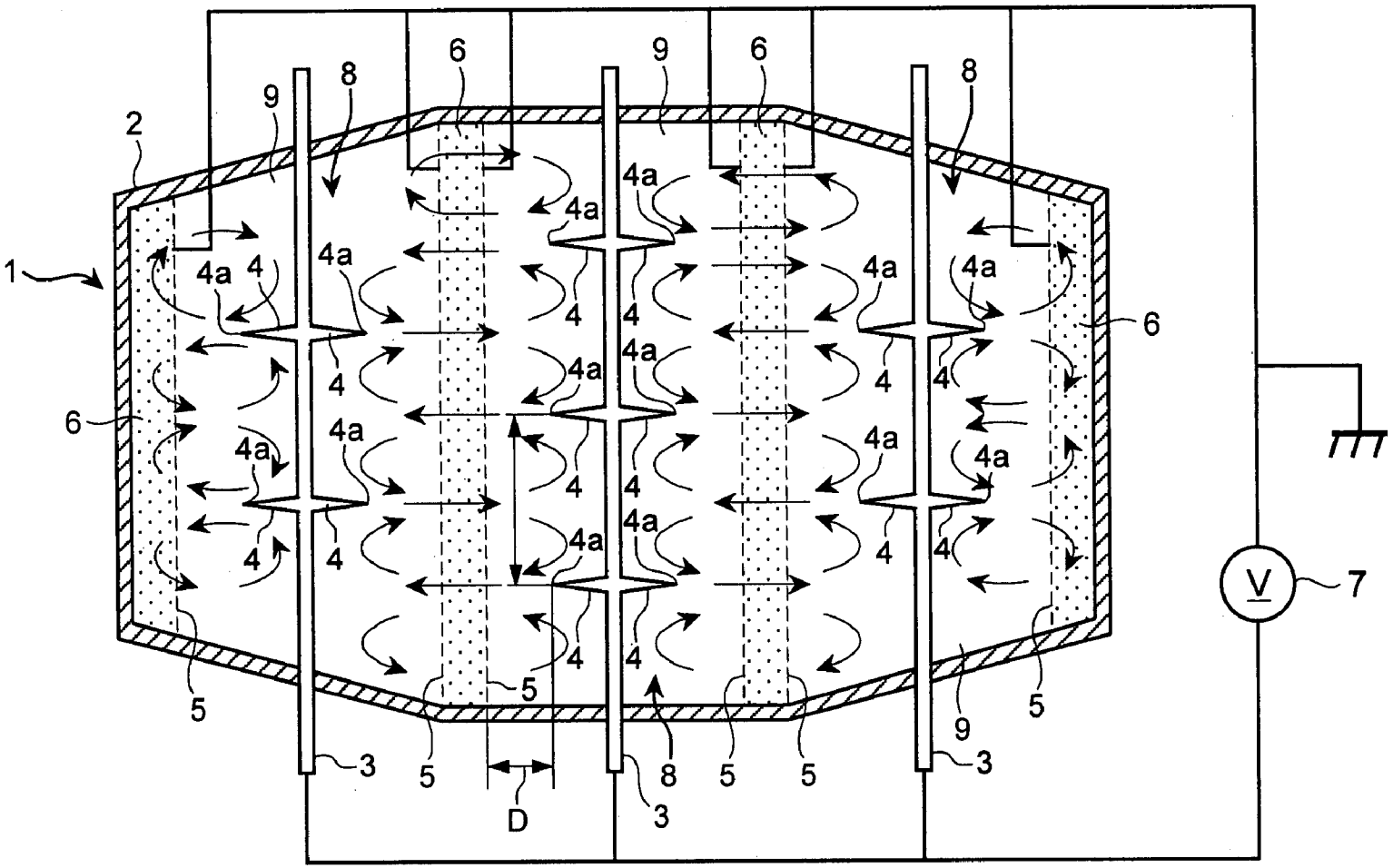
FIG. 8 is a cross section across a flow path in the dust collecting apparatus according to a fifth embodiment of the present invention.

FIG. 8 is a cross section across a flow path in the dust collecting apparatus according to a fifth embodiment of the present invention. Like reference signs are designated with like members having the same functions as in the embodiments explained above and the redundant explanation is omitted.

In the fifth embodiment, as shown in FIG. 8, the dust collecting apparatus 1 has a different arrangement from that of the dust collecting apparatus 1 and the main part 3 of the discharge electrode according to the fourth embodiment. That is, the main parts 3 of the discharge electrodes in the dust collecting apparatus 1 are provided in the same direction as that of the main parts 3 of the discharge electrodes in the dust collecting apparatus 1 according to the third embodiment. The arrangement of the discharge units 4 of the discharge electrodes in the respective cells 9 and the relative arrangement of the discharge units 4 of the discharge electrodes in the adjacent cells 9 are the same as in the dust collecting apparatus 1 according to the fourth embodiment.

Therefore, the dust collecting apparatus 1 has both the effects of the dust collecting apparatus 1 according to the third and the fourth embodiments.

Figure 9:
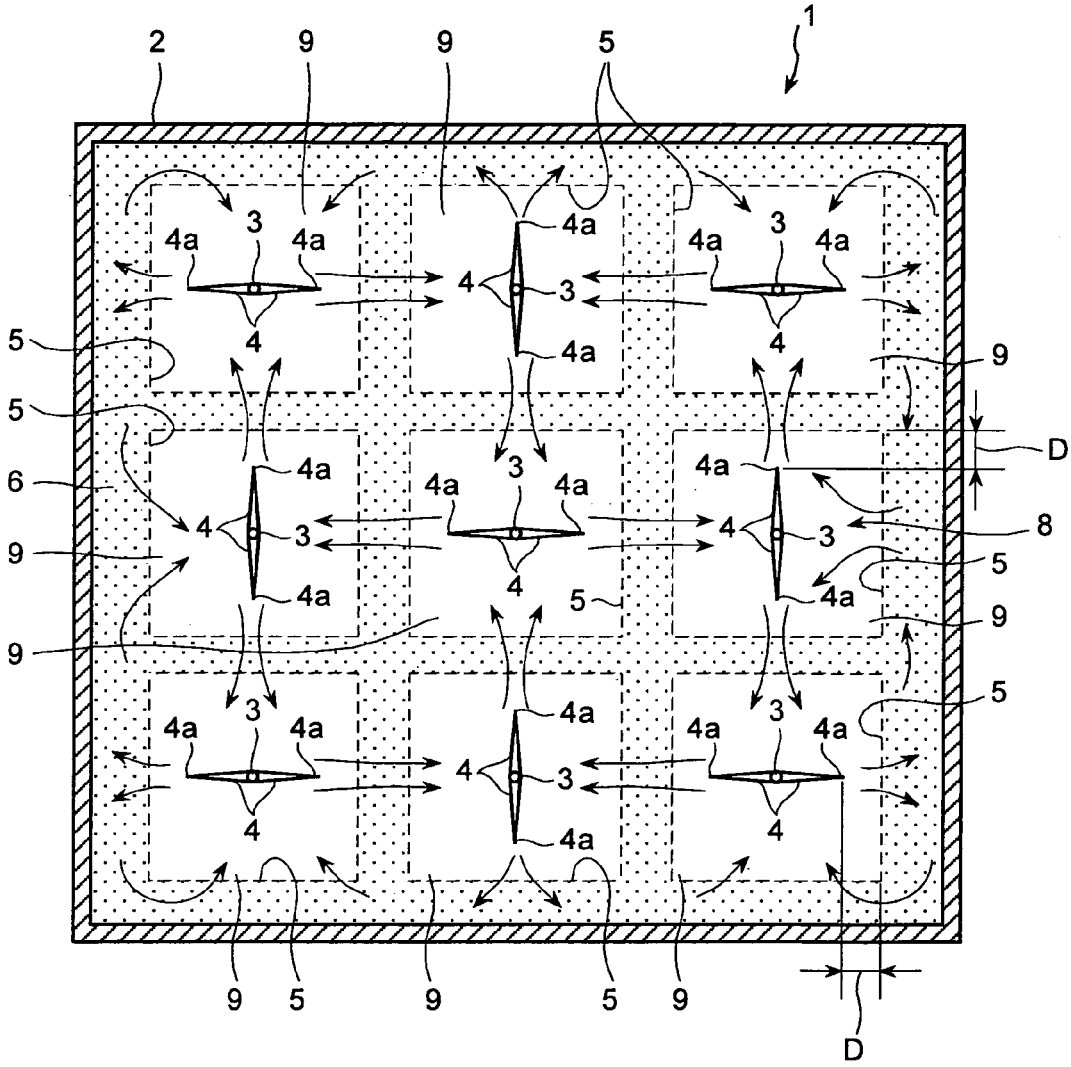
FIG. 9 is a cross section across a flow path in the dust collecting apparatus according to a sixth embodiment of the present invention.

FIG. 9 is a cross section across a flow path in the dust collecting apparatus according to a sixth embodiment of the present invention. Like reference signs are designated with like members having the same functions as in the embodiments explained above and the redundant explanation is omitted.

In the sixth embodiment, as shown in FIG. 9, a state that the dust collecting apparatus 1 arranged on the outer shell 2 side of the cell 9 on the left and right ends fills the entire space between the ground electrode 5 and the outer shell 2 is shown. However, due to the same reason explained in the first embodiment, the thickness of the dust-collecting filter layer 6 may be set to be thinner than the distance between the ground electrodes 5 and the outer shell 2, according to the use conditions. In such a case, there may be a space between the dust-collecting filter layer 6 arranged adjacent to the ground electrode 5 and the outer shell 2.

In the dust collecting apparatus 1 according to this embodiment, the flow path 8 is partitioned in a lattice shape by the dust-collecting filter layer 6, to form a plurality of cells 9. In the respective cells 9, one main part 3 of the discharge electrode is respectively arranged. The discharge units 4 of the discharge electrode are provided so as not to face the discharge unit 4 of the discharge electrode arranged in the adjacent cell 9. That is, the discharge unit 4 of the discharge electrode is provided on each main part 3 of the discharge electrode in a thorn shape extending from one adjacent cell 9 toward another adjacent cell 9. Furthermore, the discharge unit 4 of the discharge electrode is provided toward another adjacent cell 9 in an orientation different by 90 degrees with respect to the cell 9 in the orientation from which the gas flows in. Furthermore, the power supply is connected to the respective main parts 3 of the discharge electrodes and the ground electrodes 5, and a voltage is applied to generate the ion wind from the discharge units 4 of the discharge electrode toward the ground electrodes 5.

In the dust collecting apparatus 1 configured in this manner, the flow path 8 is partitioned by the dust-collecting filter layer 6 to form a plurality of cells 9, and the discharge units 4 of the discharge electrodes are arranged so that the tips 4*a* of the discharge units 4 of the discharge electrodes arranged in the adjacent cells 9 do not face each other. The gas is circulated by the ion wind in the direction transverse to the flow path 8 so as to flow out toward another adjacent cell 9 in the orientation different by 90 degrees from the orientation from which the gas flows in. The gas accelerated by the ion wind from the cell 9 arranged at a position coming in contact with the outer shell 2 toward the outer shell 2 is circulated so as to enter into the dust-collecting filter layer 6 provided along the outer shell 2, pass through the dust-collecting filter layer 6, and return to the flow path from a portion against which the ion wind is not blown. Therefore, the ion wind can be efficiently used to circulate the gas efficiently and thoroughly in a direction transverse to the flow path 8 over the whole cross section of the flow path.

In this embodiment, a state that the dust-collecting filter layer 6 arranged on the outer shell 2 side of the cell 9 on the left and right ends and the upper and lower ends fills the entire space between the ground electrodes 5 and the outer shell 2 is shown. However, due to the same reason explained in the first embodiment, the thickness of the dust-collecting filter layer 6 may be set to be thinner than the distance between the ground electrode 5 and the outer shell 2, according to the use conditions. In such a case, there may be a space between the dust-collecting filter layer 6 arranged adjacent to the ground electrode 5 and the outer shell 2.

Figure 10:
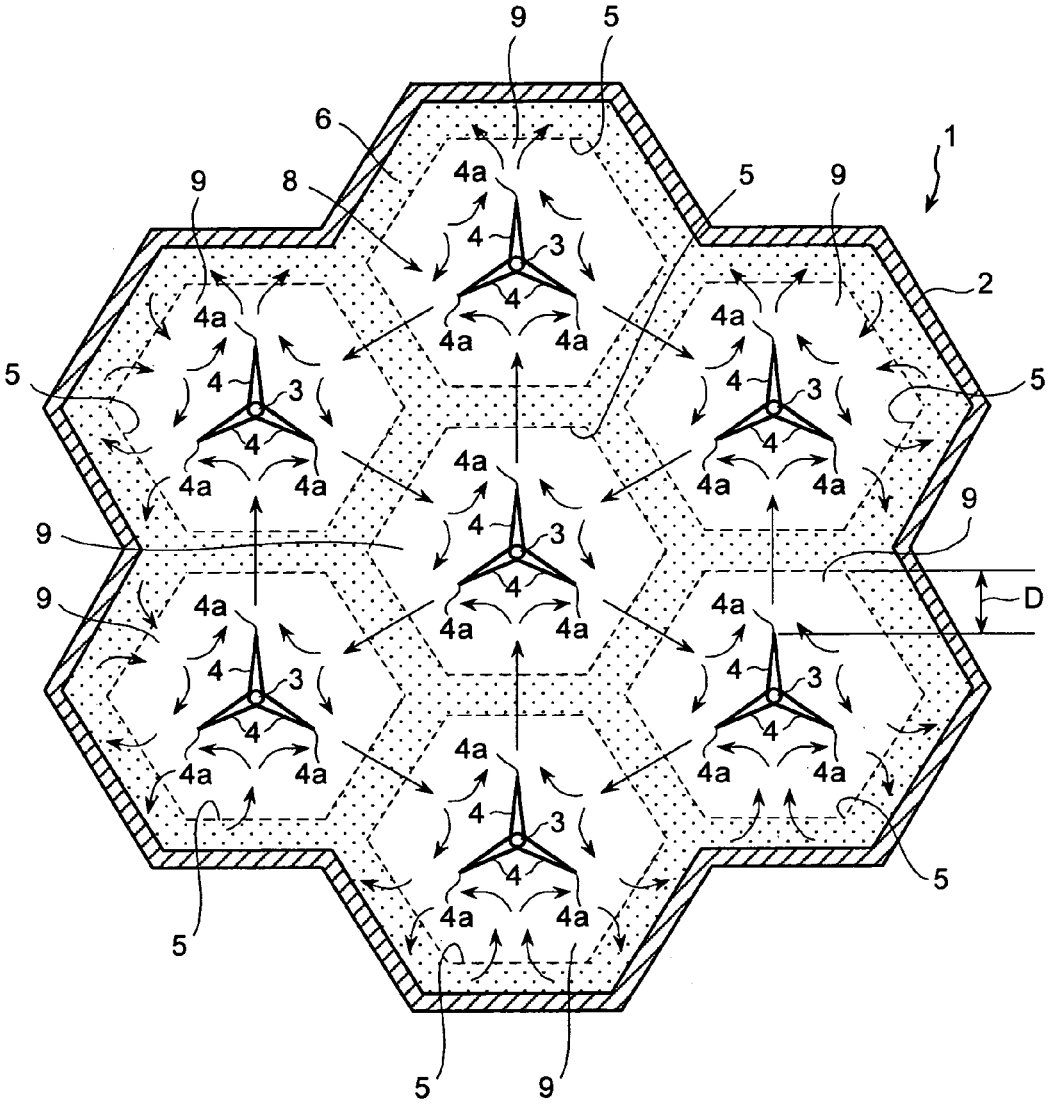
FIG. 10 is a cross section across a flow path in the dust collecting apparatus according to a seventh embodiment of the present invention.

FIG. 10 is a cross section across a flow path in the dust collecting apparatus according to a seventh embodiment of the present invention. Like reference signs are designated with like members having the same functions as in the first embodiment, and the redundant explanation is omitted.

In the seventh embodiment, as shown in FIG. 10, in the dust collecting apparatus 1, the arrangement of the cells 9 in the dust collecting apparatus 1 according to the sixth embodiment is changed to a hexagonal lattice configuration, that is, a so-called honeycomb shape. In the respective cells 9, one main part 3 of the discharge electrode is provided in the direction along the flow path 8. The discharge units 4 of the discharge electrode are formed in a thorn shape extending in the direction transverse to the flow path 8 from each main part 3 of the discharge electrode, with the tips 4*a* directed toward three directions away from each other by 120 degrees. That is, the discharge units 4 of the discharge electrode are arranged so as to extend toward three alternate faces with respect to six faces forming the cell 9.

The discharge units 4 of the discharge electrode are provided at a plurality of positions on the main part 3 of the discharge electrode along the flow path 8. If the tips 4*a* of the discharge units are provided so that the distance S between the tips 4*a* of the discharge units 4 of the discharge electrode becomes shorter in the direction along the flow path 8 than that in the direction transverse to the flow path 8, the gas in the flow path 8 is positively convected in the direction transverse to the flow path 8. Furthermore, the tips 4*a* of the discharge units 4 of the discharge electrodes of the adjacent cells 9 are arranged so as not to face each other. The power supply is connected to the respective main parts 3 of the discharge electrodes and the ground electrodes 5, and a voltage is applied to generate the ion wind from the discharge units 4 of the discharge electrode toward the ground electrodes 5.

When the gas flows into the flow path 8 in the dust collecting apparatus 1 formed in this manner, the gas is accelerated toward the adjacent cell 9 in a direction to which the tip 4*a* of the discharge unit 4 of the discharge electrode is directed, due to the ion wind generated from the tips 4*a* of the discharge units 4 of the discharge electrodes. The accelerated gas passes through the ground electrode 5 and the dust-collecting filter layer 6, and flows into the adjacent cell 9. The gas having flown in from the adjacent cell 9 is accelerated in a direction to which the discharge units 4 of the discharge electrode extend, by the ion wind generated by the discharge units 4 of the discharge electrode extending toward another adjacent cell 9 in an orientation different by 60 degrees from that of the cell 9 from which the gas has flown in, and is allowed to flow out to another adjacent cell 9 in an orientation different by 60 degrees from that of the cell 9 from which the gas has flown in. Furthermore, the gas accelerated from the cell 9 arranged at a position coming in contact with the outer shell 2 toward the outer shell 2 is convected and circulated so as to enter into the dust-collecting filter layer 6 provided along the outer shell 2, pass through the dust-collecting filter layer 6, and return to the flow path 8 from a position against which the ion wind is not blown.

Thus, the dust collecting apparatus 1 according to the seventh embodiment can form more circulation as compared to the dust collecting apparatus 1 according to the sixth embodiment. Therefore, the dust collecting apparatus 1 can collect the particulate matter contained in the gas efficiently.

In the seventh embodiment, a state that the dust-collecting filter layer 6 arranged adjacent to the outer shell 2 fills the entire space between the ground electrodes 5 and the outer shell 2 is shown. However, due to the same reason explained in the first embodiment, the thickness of the dust-collecting filter layer 6 may be set to be thinner than the distance between the ground electrode 5 and the outer shell 2, according to the use conditions. In such a case, there may be a space between the dust-collecting filter layer 6 arranged adjacent to the ground electrode 5 and the outer shell 2.

In the sixth embodiment, a case that the cross section of the respective cells 9 is square is exemplified, while in the seventh embodiment, a case that the cross section of the respective cells 9 is hexagonal is exemplified. However, the cross section of the respective cells 9 is not limited thereto. Furthermore, in these embodiments, an example in which one main part 3 of the discharge electrode is arranged in each cell 9 is shown, but the number of the main part 3 of the discharge electrode is not limited to one for each cell 9. For example, as in the fourth and the fifth embodiments, a combination in which a plurality of main part 3 of the discharge electrode is arranged in the respective cells 9 having a rectangular cross section is included in the scope of the present invention.

The ground electrode 5 according to the respective embodiments may be arranged only at a portion located in the direction to which it is preferred to generate the ion wind. In other words, the ground electrode 5 in the dust collecting apparatus 1 according to the sixth and the seventh embodiments may be arranged only between the dust-collecting filter layer 6 to which the discharge unit 4 of the discharge electrode is directed and the discharge unit 4 of the discharge electrode, without providing the ground electrode 5 so as to surround the main part 3 of the discharge electrode, and may not be arranged in a range in which the gas flows in from the adjacent cell 9.

In the explanation of the respective embodiments, a method of removing the particulate matter collected by the dust collecting apparatus 1 to the outside of the system (outside of the apparatus) is not mentioned. However, when the collected particulate matter is, for example, a flammable substance such as carbon, a method in which a heater is combined with the dust-collecting filter layer 6, to remove the particulate matter by subjecting the particulate matter to complete combustion may be used. Furthermore, it is a matter of course that a conventional method such as a wet EP, for example, water may be used in combination with a method of cleaning the dust-collecting filter layer 6, to remove the particulate matter to the outside of the system.

Figure 11:
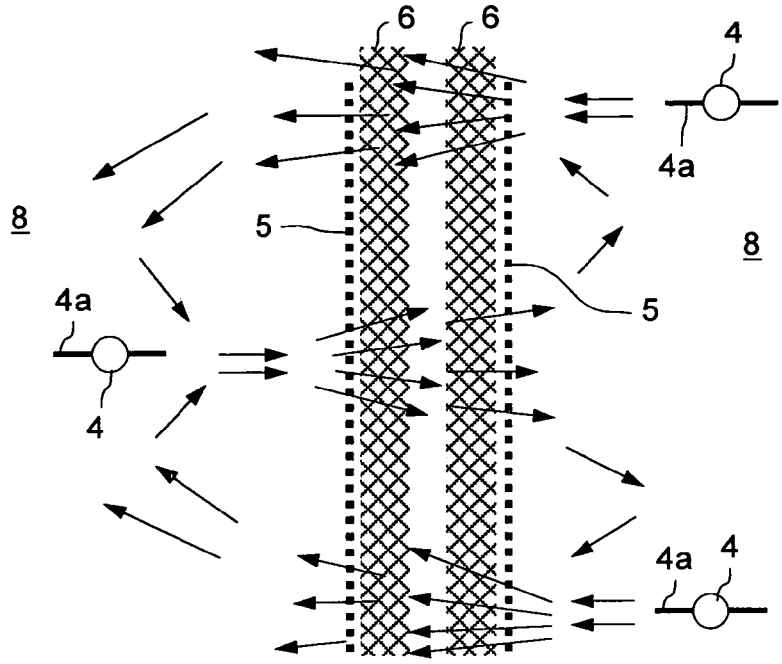
FIG. 11 is a schematic diagram of an example of arrangement of a discharge electrode, a ground electrode, and a dust-collecting filter layer in the dust collecting apparatus according to an eighth embodiment of the present invention.
Figure 12:
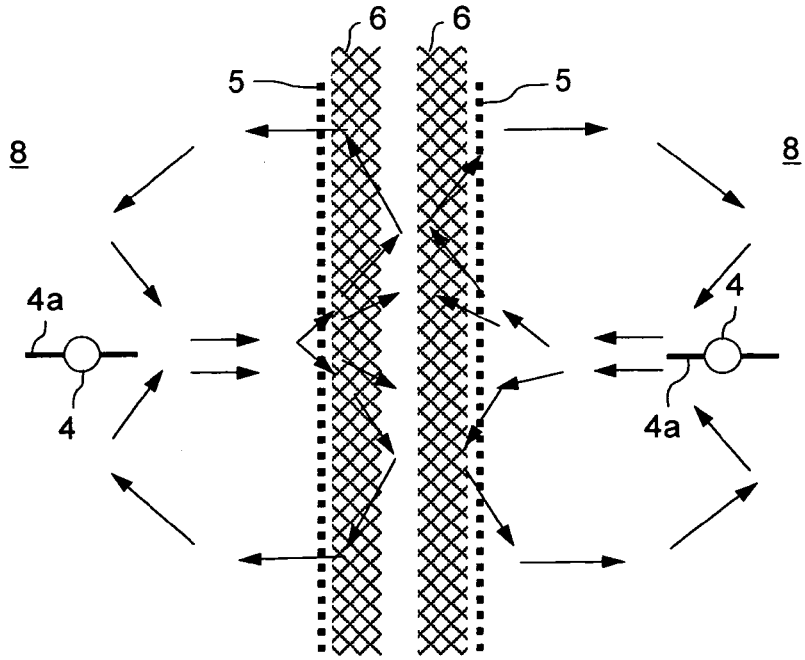
FIG. 12 is a schematic diagram of another example of arrangement of the discharge electrode, the ground electrode, and the dust-collecting filter layer in the dust collecting apparatus according to the eighth embodiment of the present invention.
Figure 13:
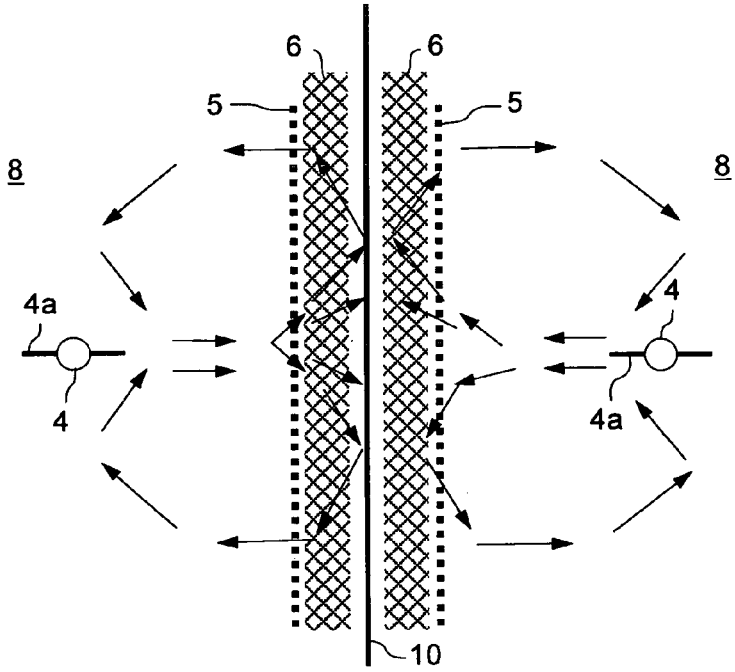
FIG. 13 is a schematic diagram of still another example of arrangement of the discharge electrode, the ground electrode, and the dust-collecting filter layer in the dust collecting apparatus according to the eighth embodiment of the present invention.
Figure 14:
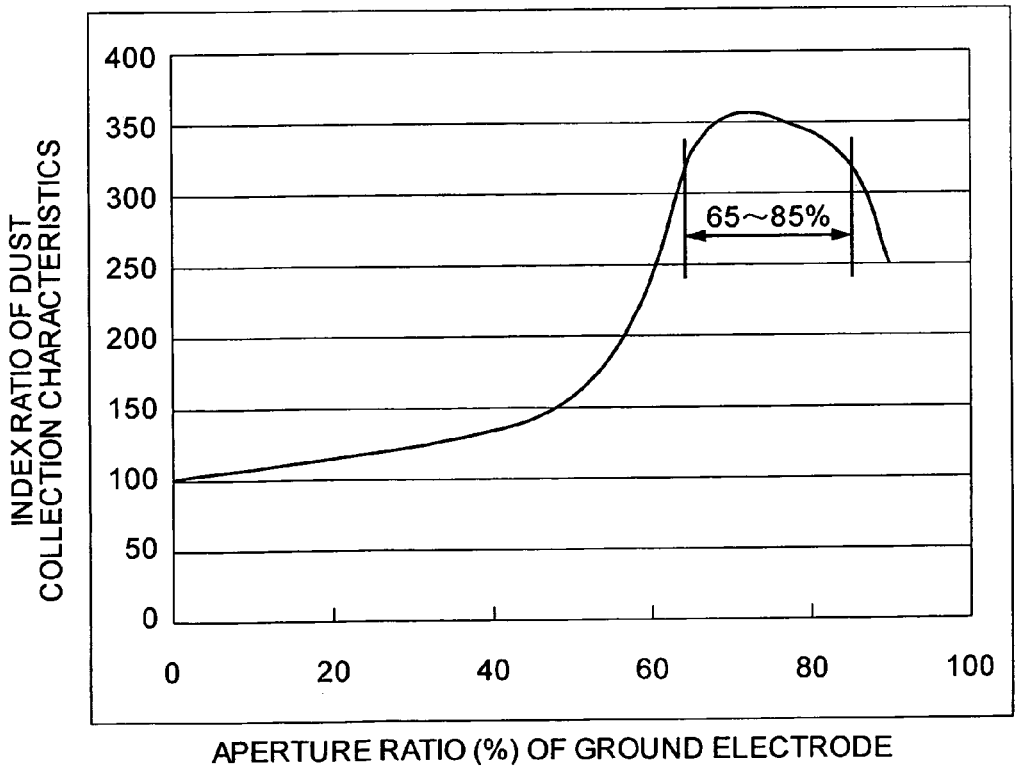
FIG. 14 is a graph of an index ratio of dust collection characteristics with respect to an aperture ratio of a ground electrode.
Figure 15:
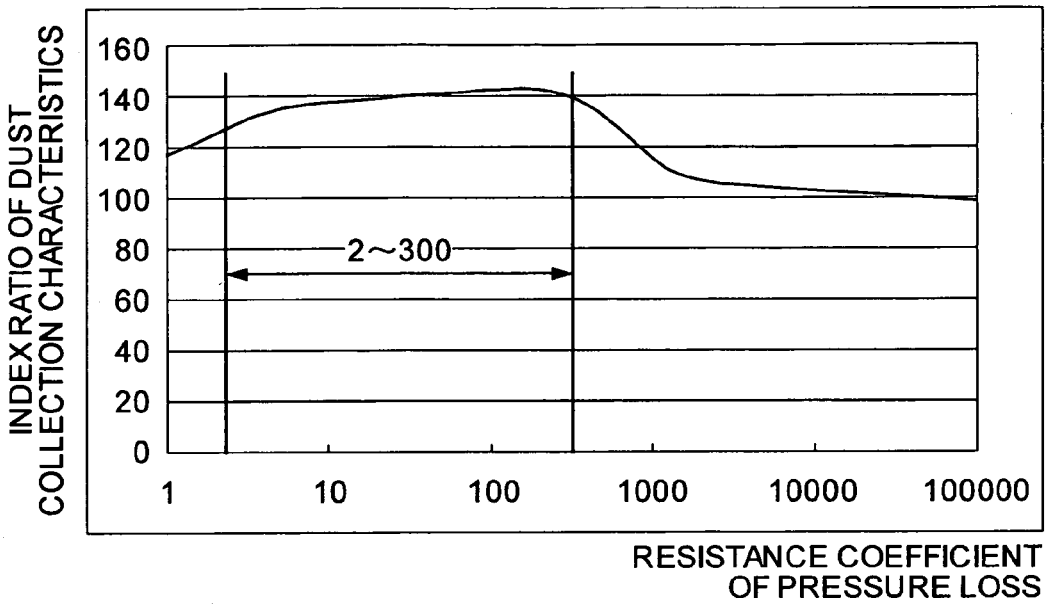
FIG. 15 is a graph of an index ratio of dust collection characteristics with respect to a resistance coefficient of pressure loss in a dust-collecting filter layer.
Figure 16:
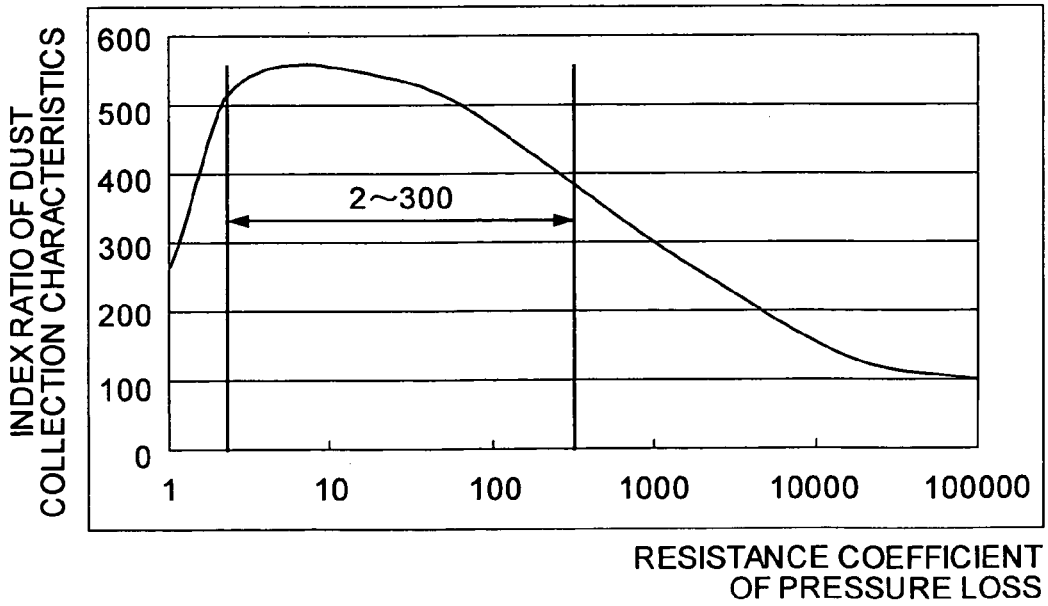
FIG. 16 is a graph of an index ratio of dust collection characteristics with respect to a resistance coefficient of pressure loss in the dust-collecting filter layer.

FIGS. 11 to 13 are schematic diagrams, respectively depicting an example of arrangement of the discharge electrode, the ground electrode, and the dust-collecting filter layer in the dust collecting apparatus according to an eighth embodiment of the present invention. FIG. 14 is a graph of an index ratio of the dust collection characteristics with respect to an aperture ratio of the ground electrode, FIG. 15 is a graph of an index ratio of dust collection characteristics with respect to a resistance coefficient of pressure loss in the dust-collecting filter layer, and FIG. 16 is another graph of an index ratio of dust collection characteristics with respect to a resistance coefficient of pressure loss in the dust-collecting filter layer. Like reference signs are designated with like members having the same functions as in the embodiments described above, and the redundant explanation is omitted.

The dust collecting apparatus according to the present invention is achieved by paying attention to the fact that the influence of the main gas flow is little, and the secondary flow due to the ion wind can be generated in the cross section of the flow path orthogonal to the main gas flow. The dust collecting apparatus charges the particulate matter to collect the particulate matter onto the ground electrode due to the electrostatic force, and allows the gas flowing in the flow path to be convected by the ion wind, and the gas helically rotates three-dimensionally, to pass through the dust-collecting filter layer repetitively, thereby enabling collection of the particulate matter having fine particle diameters, which is hard to be charged, more efficiently in the dust-collecting filter layer 6.

In this case, the aperture ratio (porosity and pressure loss) of the ground electrode and the dust-collecting filter layer largely affects the discharge electrode. In the eighth embodiment, the configuration of the ground electrode and the dust-collecting filter layer will be made clear.

The arrangement of the discharge electrode, the ground electrode and the dust-collecting filter layer will be explained first. In the example shown in FIG. 11, two dust-collecting filter layers 6 are arranged adjacent to each other, the ground electrode 5 is provided on each surface thereof, and the discharge unit 4 of the discharge electrode is arranged with respect to the respective ground electrodes 5, with the tips 4*a* thereof being away from each other by a predetermined distance. The directions indicated by the tips 4*a* of the discharge units 4 of the left and right discharge electrodes are shifted from the direction facing each other in the direction transverse to the flow path 8. It is preferred that the distance between nodes of perpendiculars brought down from the tips 4*a* of the discharge units 4 to the ground electrode 5 be in the same range as in the respective embodiments described above.

Accordingly, when the gas containing the particulate matter flows into the flow path 8, the particulate matter in the gas is charged by the corona discharge generated from the tips 4*a* of the discharge units 4 of the discharge electrodes so as to be attracted to the ground electrode 5. Furthermore, the gas is accelerated toward the ground electrode 5 by the ion wind generated from the tips 4*a* of the discharge units 4 of the discharge electrodes toward the ground electrode 5. The gas accelerated in the direction transverse to one of the flow path 8 passes through the ground electrode 5 and the dust-collecting filter layer 6, and flows into the other flow path 8. In the other flow path 8 into which the gas flows, the discharge unit 4 of the discharge electrode is provided at a position shifted from the position from which the gas flows in, and from this discharge unit 4 of the discharge electrode, the ion wind is generated likewise, so that the accelerated gas passes through the ground electrode 5 and the dust-collecting filter layer 6, and flows into the one flow path 8. In other words, due to the ion wind generated from the respective discharge units 4 of the discharge electrodes, the gas is circulated between the adjacent flow paths 8, and moves while rotating helically and three-dimensionally. Accordingly, the gas passes through the dust-collecting filter layer 6 repetitively, where the particulate matter is reliably collected.

In the example shown in FIG. 12, two dust-collecting filter layers 6 are arranged adjacent to each other, the ground electrode 5 is provided on each surface thereof, and the discharge unit 4 of the discharge electrode is arranged with respect to the respective ground electrodes 5, with the tips 4*a* thereof being away from each other by a predetermined distance. The directions indicated by the tips 4*a* of the discharge units 4 of the left and right discharge electrodes face each other in the direction transverse to the flow path 8.

Accordingly, when the gas containing the particulate matter flows into the flow path 8, the particulate matter in the gas is charged by the corona discharge and the gas is accelerated toward the ground electrode 5 by the ion wind. The gas accelerated in the direction transverse to one of the flow path 8 passes through the ground electrode 5 and flows into the dust-collecting filter layer 6. In the other flow path 8, the discharge unit 4 of the discharge electrode is provided at a position opposite to the discharge unit 4 of the discharge electrode in the one flow path 8, and from this discharge unit 4 of the discharge electrode, the ion wind is generated likewise, so that the accelerated gas passes through the ground electrode 5 and flows into the dust-collecting filter layer 6. In other words, due to the ion wind generated from the respective discharge units 4 of the discharge electrodes, the gas moves while rotating helically and three-dimensionally for each flow path 8. Accordingly, the gas passes through the dust-collecting filter layer 6 repetitively, where the particulate matter is reliably collected.

In the example shown in FIG. 13, two dust-collecting filter layers 6 are arranged adjacent to each other, the ground electrode 5 is provided on each surface thereof, and the discharge unit 4 of the discharge electrode is arranged with respect to the respective ground electrodes 5, with the tips 4*a* thereof being away from each other by a predetermined distance. A partition plate 10 is provided between the left and right dust-collecting filter layers 6.

Accordingly, when the gas containing the particulate matter flows into the flow path 8, the particulate matter in the gas is charged by the corona discharge and the gas is accelerated toward the ground electrode 5 by the ion wind. The gas accelerated in the direction transverse to the respective flow paths 8 passes through the ground electrode 5 and flows into the dust-collecting filter layer 6. Due to the ion wind generated from the respective discharge units 4 of the discharge electrodes, the gas moves while rotating helically and three-dimensionally in each flow path 8. Accordingly, the gas passes through the dust-collecting filter layer 6 repetitively, where the particulate matter is reliably collected.

Thus, the arrangement of the discharge unit 4 of the discharge electrode, the ground electrode 5, and the dust-collecting filter layer 6 can be considered variously, and is not limited thereto. Other than the examples above, the adjacent two dust-collecting filter layers 6 may be integrally formed, the dust-collecting filter layer 6 and the partition plate 10 may be stuck together, or a gap may be provided therebetween.

It is preferred that the aperture ratio of the ground electrode 5 is set to be 65% to 85%, by the dust collecting apparatus configured in the above manner. Here, the dust collection efficiency η of the dust collecting apparatus can be calculated by the following well-known Deutch's expression, where w denotes an index of dust collection characteristics (moving speed of the particulate matter), and f denotes a dust collection area per unit gas amount.

$$\eta=1-\exp(-w\times f)$$

From this expression, it is understood that the larger the index w of the dust collection characteristics is, the higher the dust collection efficiency η becomes.

The graph shown in FIG. 14 expresses the index ratio of the dust collection characteristics with respect to the aperture ratio of the ground electrode, in which changes in the index ratio of the duct collection characteristics when the aperture ratio of the ground electrode is changed are obtained by experiments. Therefore, as shown in the graph in FIG. 14, the area where the index ratio of the duct collection characteristics higher than 300 can be ensured is the area in which the aperture ratio of the ground electrode is from 65% to 85%. In this case, if the aperture ratio of the ground electrode is lower than 65%, the particulate matter in the gas cannot be reliably guided to the dust-collecting filter layer together with the ion wind, and hence, the ion wind cannot be used effectively, and large performance improvement cannot be expected. On the contrary, if the aperture ratio of the ground electrode is higher than 85%, for example, when the ground electrode is formed of a wire net, since wires having a fine wire diameter are arranged by thinning, the surface potential rises and reaches spark discharge without a sufficient current capable of supplying the ion wind flowing thereto, thereby causing a limitation on the performance. In the graph in FIG. 14, the index ratio of the dust collection characteristics indicates a relative comparison designating the index ratio of the dust collection characteristics of the ground electrode having the conventional configuration, that is, the ground electrode made of an iron plate as 100 as a reference value, and hence, when the aperture ratio is 0%, the index shows 100.

In this case, it is preferred to set the aperture ratio of the ground electrode to be larger than that of the dust-collecting filter layer 6. That is, the ground electrode 5 charges and attracts the particulate matter upon reception of corona discharge from the discharge unit 4 of the discharge electrode, and on the other hand, the dust-collecting filter layer 6 collects the charged particulate matter. Accordingly, it is required that the ground electrode 5 can introduce the particulate matter to the dust-collecting filter layer as much as possible. However, the dust-collecting filter layer 6 is formed of laminated wire net or porous ceramics, and hence, it is appropriate to express it by the porosity rather than by the aperture ratio. In this case, the porosity of the ground electrode 5 needs only to be set larger than the porosity of the dust-collecting filter layer 6.

In the dust collecting apparatus, it is preferred to set the resistance coefficient of pressure loss in the dust-collecting filter layer 6 to 2 to 300. As described above, the dust collection efficiency η of the dust collecting apparatus can be calculated by the following expression:

$$\eta=1-\exp(-w\times f).$$

From this expression, it is understood that the larger the index w of the dust collection characteristics is, the higher the dust collection efficiency η becomes.

Furthermore, the pressure loss ΔP in the dust-collecting filter layer can be calculated by the following expression. By making the pressure loss coefficient appropriate, the high dust collection characteristics can be ensured. Here, ξ denotes a resistance coefficient of pressure loss, γ denotes a specific gravity of the gas, V denotes a passing flow rate through the dust-collecting filter layer, and g denotes gravity.

$$\Delta P=\xi\times\gamma\times V^2/2g.$$

The resistance coefficient of pressure loss ξ is data obtained by calculating the pressure loss ΔP as mmaq.

Graphs shown in FIGS. 15 and 16 are an index ratio of dust collection characteristics with respect to the resistance coefficient of pressure loss in the dust-collecting filter layer, wherein in FIG. 15, data obtained by using fly ash dust as the particulate matter is shown, and in FIG. 16, data obtained by using diesel exhaust gas dust as the particulate matter is shown. These graphs indicate the degree of change in the index ratio of the dust collection characteristics when the resistance coefficient of pressure loss is changed based on the expression of the pressure loss ΔP, obtained by experiments. As shown in FIGS. 15 and 16, the area where a high index ratio of the dust collection characteristics can be ensured is an area in which the resistance coefficient of pressure loss is from 2 to 300.

In other words, when the pressure loss coefficient is small, the gas induced by the secondary flow due to the ion wind can be sufficiently introduced into the filter layer, and the original object can be attained. However, since the porosity of the filter layer is very large, that is, the gap is too large as the filter layer, the particulate matter is returned to the gas without being collected sufficiently. As a result, sufficient efficiency cannot be attained. On the contrary, when the pressure loss coefficient is large, since the gas induced by the secondary flow cannot be sufficiently introduced into the filter layer, sufficient efficiency cannot be attained.

In the graphs shown in FIGS. 15 and 16, the index ratio of the dust collection characteristics indicates a relative comparison designating the index ratio of the dust collection characteristics of the ground electrode made of an iron plate as 100 as a reference value. In this case, though the resistance coefficient of pressure loss is infinite, when the resistance coefficient of pressure loss is 100,000, the index ratio of the dust collection characteristics is 100.

INDUSTRIAL APPLICABILITY

The dust collecting apparatus according to the present invention charges the particulate matter in the gas and allows the gas to circulate between the gas passage and the dust-collecting filter layer along the main gas flow, due to the ion wind, to collect the particulate matter while allowing the gas to pass through the dust-collecting filter layer repetitively. The dust collecting apparatus according to the present invention is useful as a dust collecting apparatus that collects fine particles in the gas efficiently, and particularly, suitable for processing handling the gas containing fine particulate matter.

The invention claimed is:

1. An apparatus for collecting particulate matter contained in a gas flowing through a flow path formed in a cylindrical shape having an outer surface and an inner surface, the apparatus comprising:

an outer shell that forms the outer surface of the flow path;

a ground electrode that forms the inner surface of the flow path;

a filter layer that is arranged between the outer shell and the ground electrode; and a discharge electrode that generates, when a voltage is applied, an ion wind inducing a secondary flow toward the ground electrode in a direction transverse to the flow path, wherein the ground electrode includes an aperture that allows the secondary flow to pass through the ground electrode in the direction transverse to the flow path, and the filter layer includes a first aperture that allows the secondary flow to pass through the filter layer in the direction transverse to the flow path; and a second aperture that allows the secondary flow to pass through the filter layer along the flow path.

2. The apparatus according to claim 1, wherein the discharge electrode includes a main part that extends along the flow path; and a plurality of sub parts each of which is formed in a thorn shape and extends from the main part toward the ground electrode.

3. The apparatus according to claim 1, wherein the discharge electrode includes a plurality of main parts that are aligned in the direction transverse to the flow path, each of the main parts extending along the flow path; and a plurality of sub parts each of which is formed in a thorn shape and extends from each of the main parts toward the ground electrode.

4. The apparatus according to claim 1, wherein the discharge electrode includes a plurality of main parts that are aligned along the flow path, each of the main parts extending in the direction transverse to the flow path; and a plurality of sub parts each of which is formed in a thorn shape and extends from each of the main parts toward the ground electrode.

5. An apparatus for collecting particulate matter contained in a gas flowing through a flow path having a cross section partitioned into a plurality of cells, the apparatus comprising:

an outer shell surrounding the flow path;

a filter layer that is arranged between the cells;

a ground electrode that is arranged on the filter layer; and a plurality of discharge electrodes each of which generates, when a voltage is applied, an ion wind inducing a secondary flow toward the ground electrode in a direction transverse to the flow path, wherein the ground electrode includes an aperture that allows the secondary flow to pass through the ground electrode in the direction transverse to the flow path, and the filter layer includes a first aperture that allows the secondary flow to pass through the filter layer in the direction transverse to the flow path; and a second aperture that allows the secondary flow to pass through the filter layer along the flow path.

6. The apparatus according to claim 5, wherein the filter layer is arranged between the outer shell and a cell adjacent to the outer shell, and the ground electrode is arranged on the filter layer on a side opposite to the outer shell.

7. The apparatus according to claim 5, wherein the ground electrode is arranged on the filter layer that is on a side of a tip of the discharge electrode.

8. The apparatus according to claim 5, wherein the cross section forms a lattice.

9. The apparatus according to claim 5, wherein the cross section forms a honeycomb.

10. The apparatus according to claim 5, wherein the gas is circulated between adjacent cells by the ion wind.

11. An apparatus for collecting particulate matter contained in a gas flowing through a flow path, the apparatus comprising:

a ground electrode that is arranged along the flow path and has an aperture that allows the gas to pass through the ground electrode in a direction transverse to the flow path;

a filter layer that is arranged adjacent to the ground electrode and includes a first aperture that allows the gas to pass through the filter layer in the direction transverse to the flow path; and a second aperture that allows the gas to pass through the filter layer along the flow path; and a discharge electrode that is arranged in the flow path with a tip of the discharge electrode having a predetermined distance from the ground electrode, wherein a voltage is applied to the ground electrode and the discharge electrode to generate an ion wind inducing a secondary flow from the discharge electrode to the ground electrode, thereby generating a helical gas flow between the flow path and the filter layer.

12. The apparatus according to claim 11, wherein a first ratio of an aperture area to a non-aperture area of the ground electrode is larger than a second ratio of an aperture area to a non-aperture area of the filter layer.

13. The apparatus according to claim 12, wherein the first ratio is in a range between 65% and 85%.

14. The apparatus according to claim 11, wherein the filter layer has a resistance coefficient of pressure loss in a range between 2 and 300.

* * * * *